US010653972B2

(12) United States Patent
Welby

(10) Patent No.: US 10,653,972 B2
(45) Date of Patent: May 19, 2020

(54) TOY VEHICLE PLAYSET WITH ROTATING BASE

(71) Applicant: Mattel, Inc., El Segundo, CA (US)

(72) Inventor: David Welby, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 263 days.

(21) Appl. No.: 15/895,113

(22) Filed: Feb. 13, 2018

(65) Prior Publication Data

US 2018/0229138 A1 Aug. 16, 2018

Related U.S. Application Data

(60) Provisional application No. 62/459,535, filed on Feb. 15, 2017.

(51) Int. Cl.
*A63H 18/02* (2006.01)
*A63H 18/16* (2006.01)

(52) U.S. Cl.
CPC ..... *A63H 18/028* (2013.01); *A63H 18/16* (2013.01)

(58) Field of Classification Search
CPC ..... A63H 18/00; A63H 18/02; A63H 18/028; A63H 18/04; A63H 18/06; A63H 18/16
See application file for complete search history.

(56) References Cited

U.S. PATENT DOCUMENTS 1,527,006 A 2/1925 O'Reilly
3,735,923 A 5/1973 Brigham
4,203,247 A 5/1980 Moe
4,267,661 A * 5/1981 Hanson ..... A63H 17/008 124/21
4,357,778 A 11/1982 Matsumoto
5,254,030 A 10/1993 Ostendorff
5,586,923 A 12/1996 Hippely
5,871,385 A * 2/1999 Hippely ..... A63H 18/026 18/26
5,899,789 A 5/1999 Rehkemper
6,478,654 B1 11/2002 Rehkemper
6,676,480 B2 1/2004 Sheltman
6,913,508 B2 7/2005 Hornsby
7,819,720 B2 10/2010 Nuttall
7,857,679 B2 12/2010 O'Connor
7,901,266 B2 3/2011 Ostendorff
7,934,970 B2 5/2011 O'Connor
(Continued)

*Primary Examiner* — Robert J McCarry, Jr.
(74) *Attorney, Agent, or Firm* — Edell, Shapiro & Finnan, LLC

(57) ABSTRACT

A toy vehicle playset includes a base, a platform, and a launcher. The base is configured to support the platform on a support surface, where the platform is rotatably coupled to the base and configured to rotate about a vertical axis with respect to the base. The launcher is coupled to the base via a launch track. The platform includes at least one track disposed within the top surface of the platform, at least one ramp extending upwardly from the top surface of the platform, and at least one overhead track extending from the ramp over the top surface of the platform. The at least one track, at least one ramp, and at least one overhead track form a continuous track on the platform. The launcher is configured to launch a toy vehicle onto the continuous track of the platform as the platform rotates about the vertical axis.

20 Claims, 20 Drawing Sheets

(56) References Cited

U.S. PATENT DOCUMENTS

| | | | | |
|---|---|---|---|---|
| 8,192,246 | B2 * | 6/2012 | Ostendorff | A63H 18/028 18/28 |
| 9,314,704 | B2 | 4/2016 | Ostendorff | |
| 2003/0224697 | A1 | 12/2003 | Sheltman | |
| 2005/0287918 | A1 | 12/2005 | Sheltman | |
| 2007/0197127 | A1 | 8/2007 | Ostendorff | |
| 2007/0293122 | A1 | 12/2007 | O'Connor | |
| 2009/0075558 | A1 | 3/2009 | Ostendorff | |
| 2011/0021111 | A1 | 1/2011 | Nuttall | |
| 2011/0081825 | A1 | 4/2011 | Jourdian | |
| 2011/0269370 | A1 | 11/2011 | O'Connor | |
| 2012/0264350 | A1 * | 10/2012 | Ostendorff | A63H 18/16 446/430 |
| 2013/0078887 | A1 * | 3/2013 | Payne | A63H 17/26 446/429 |
| 2013/0109271 | A1 | 5/2013 | Ferreyra | |
| 2013/0231028 | A1 | 9/2013 | Ostendorff | |
| 2013/0309937 | A1 * | 11/2013 | Ostendorff | A63H 18/028 18/28 |
| 2015/0060560 | A1 | 3/2015 | Yu | |
| 2015/0097045 | A1 | 4/2015 | Lennon | |
| 2015/0122903 | A1 | 5/2015 | Boyce | |

* cited by examiner

TOY VEHICLE PLAYSET WITH ROTATING BASE

CROSS-REFERENCE TO RELATED APPLICATION

This application claims the benefit of U.S. Provisional Patent Application No. 62/459,535, filed Feb. 15, 2017, entitled "Toy Vehicle Playset with Rotating Base," the entire disclosure of which is incorporated by reference herein.

FIELD OF THE INVENTION

The present invention relates to a toy vehicle playset. More specifically, the invention relates to toy vehicle playset that includes a continuous closed loop track disposed on a rotating platform and a series of launchers configured to launch toy vehicles into the continuous closed loop track.

BACKGROUND OF THE INVENTION

A common way for children to play with toy vehicles is with a toy vehicle playset. Often, toy vehicle playsets include multiple different tracks, and users may direct or propel toy vehicles over or through the multiple different tracks. With some play patterns, the user may decide which track the toy vehicle will travel by manually guiding (i.e., pushing the car down one or another) the toy vehicle along a toy vehicle track. With other play patterns, the user may launch toy vehicles along the track via a launcher. However, these conventional toy vehicle track sets are often static (i.e., with limited or no moving parts), which limit the number of play patterns and the replay value of the toy vehicle playsets. In addition, the conventional toy vehicle playsets do not provide the functionality or ability for users to play a game (i.e., competition with another user) with the toy vehicle playset.

Therefore, it would be desirable to provide a toy vehicle playset with continuous closed loop track disposed on a rotating platform. Moreover, it would be desirable for a toy vehicle playset to include a plurality of launchers that are configured for multiple users to attempt to launch toy vehicles into the rotating platform such that the toy vehicles enter and travel along the continuous closed loop track.

SUMMARY OF THE INVENTION

An improved toy vehicle playset is disclosed herein. The toy vehicle playset includes a base, a platform, and a launcher. The base is configured to support the platform on a support surface, where the platform is rotatably coupled to the base and configured to rotate about a vertical axis with respect to the base. The launcher is coupled to the base via a launch track. The platform includes at least one track disposed within the top surface of the platform, at least one ramp extending upwardly from the top surface of the platform, and at least one overhead track extending from the ramp over the top surface of the platform. The at least one track, at least one ramp, and at least one overhead track form a continuous closed loop track on the platform. The launcher is configured to launch a toy vehicle onto the continuous track of the platform as the platform rotates about the vertical axis with respect to the launcher.

BRIEF DESCRIPTION OF THE DRAWINGS

FIG. 8B shows a booster wheel assembly from the booster of FIG. 8A.

FIG. 8C shows a front cross-section of a thin-walled member of the booster wheel of FIG. 8B in a resting configuration.

FIG. 8D shows a front cross-section of the thin-walled member of FIG. 8C in a compressed configuration.

Like reference numerals have been used to identify like elements throughout this disclosure.

DETAILED DESCRIPTION OF THE INVENTION

The present invention disclosed herein is toy vehicle playset that includes at least one toy vehicle launcher, a platform, and a continuous closed loop track disposed on the platform. The platform of the toy vehicle playset, and thus the continuous closed loop track, are configured to rotate about a substantially vertical axis with respect to the toy vehicle launcher. The platform and continuous closed loop track include at least one entry into the continuous track, where the entry includes a door that is reconfigurable between an open position and a closed position. The door of the entry is typically positioned in the closed position. However, when a toy vehicle is launched from the launcher into the entry, the toy vehicle temporarily repositions the door to the open position, passes through the door, and enters the continuous closed loop track of the platform. Once a toy vehicle successfully enters the continuous closed loop track, the toy vehicle may continue to travel along the continuous closed loop track as the platform and the continuous closed loop track rotate.

Figure 1:
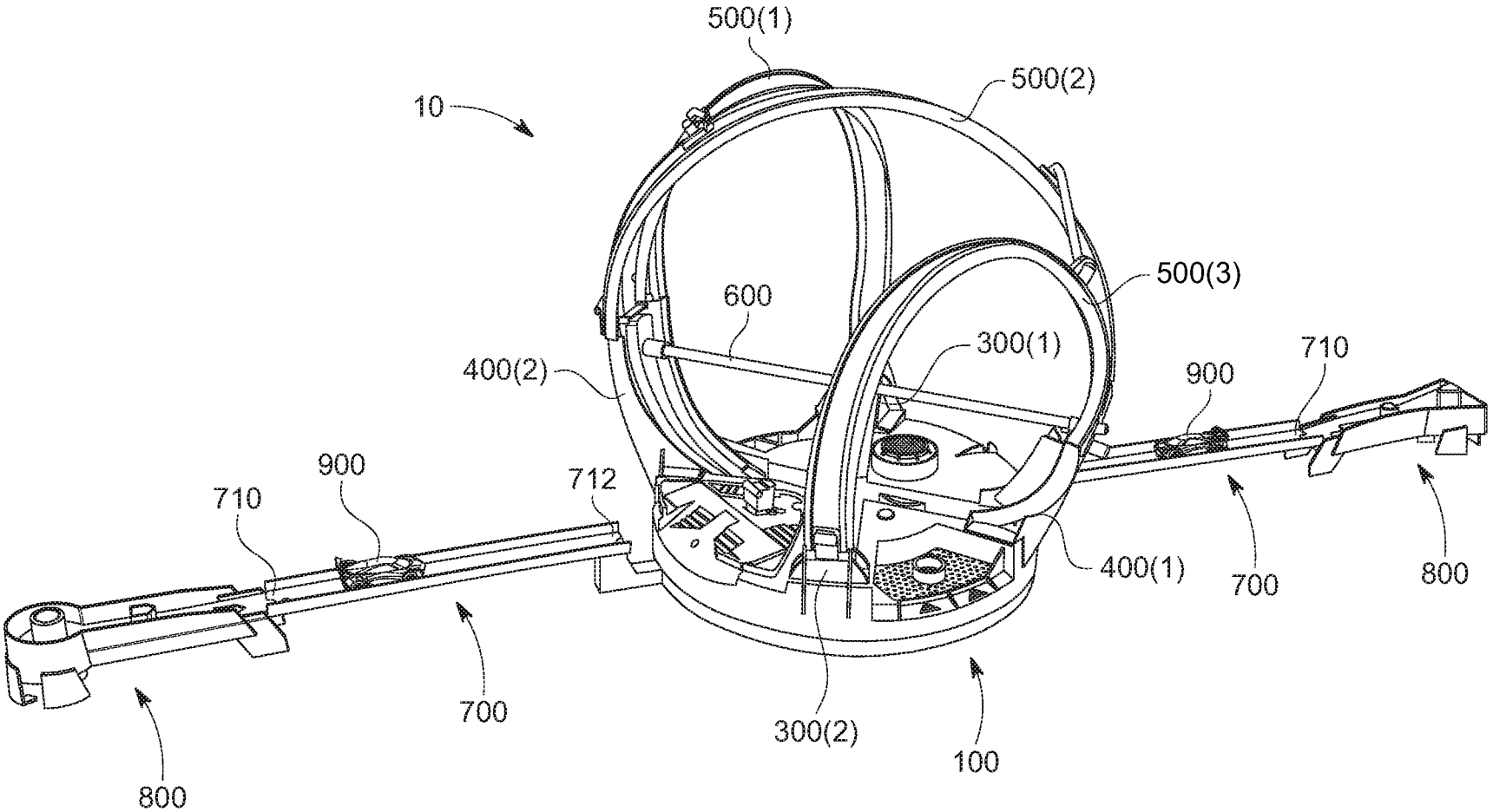
FIG. 1 illustrates a perspective view of an embodiment of a toy vehicle playset according to the present invention.
Figure 2A:
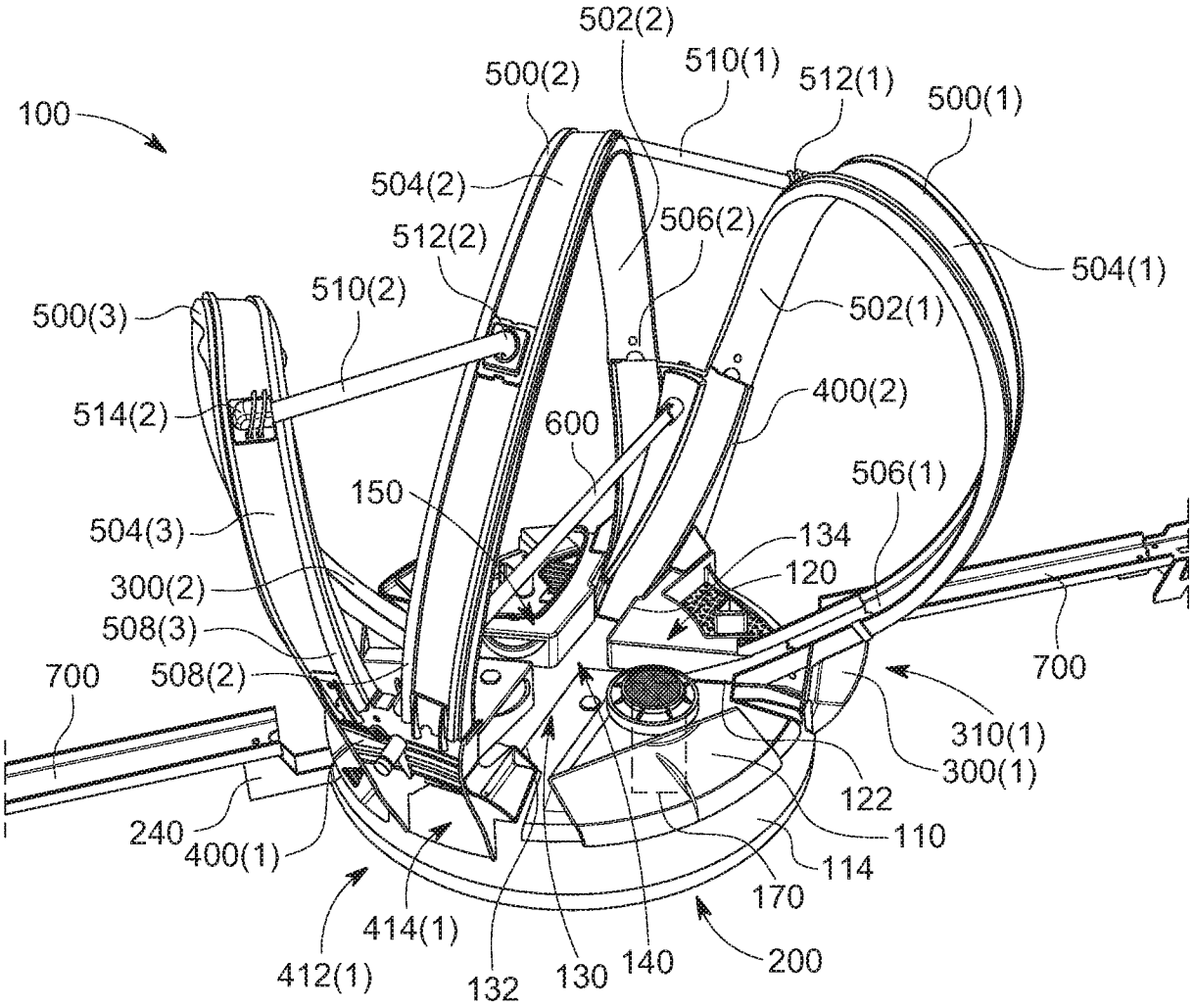
FIG. 2A illustrates a perspective view of the platform of the embodiment of the toy vehicle playset illustrated in FIG. 1.
Figure 2B:
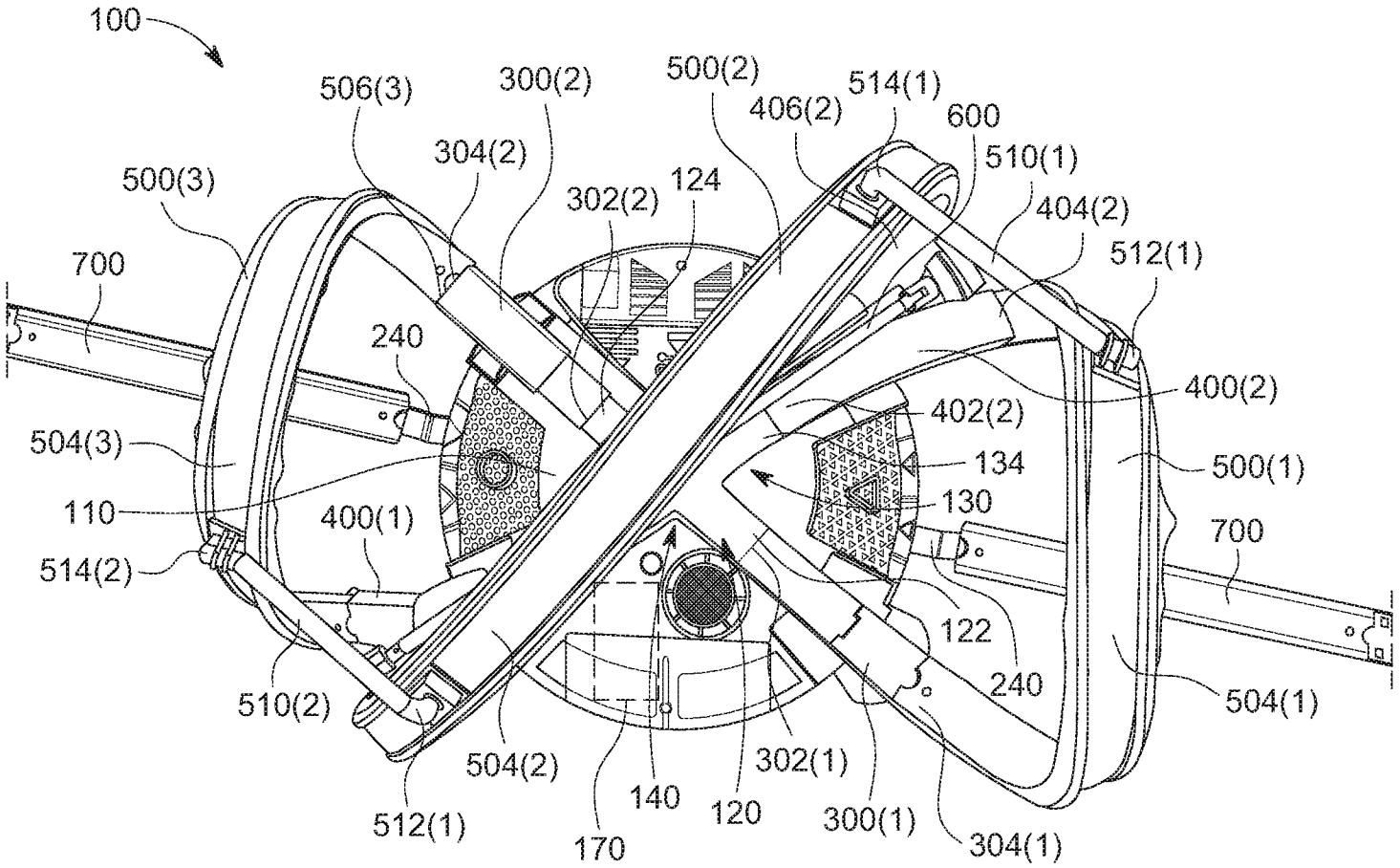
FIG. 2B illustrates a top view of the platform of the embodiment of the toy vehicle playset illustrated in FIG. 2A.

Illustrated in FIGS. 1, 2A, and 2B is an embodiment of a toy vehicle playset 10 in accordance with the present invention. The toy vehicle track playset 10 includes a platform 100 rotatably disposed on a base 200 and a two launchers 800 coupled to the base 200 via launch tracks 700. Disposed on the platform 100 of the toy vehicle playset 10 is a pair of first ramps 300(1), 300(2) and a pair of second ramps 400(1), 400(2) that are coupled to one another via a set of overhead tracks 500(1), 500(2), 500(3). The platform 100 further includes a diverter mechanism 600 that is configured to direct toy vehicles 900 around the platform 100, first and second ramps 300(1), 300(2), 400(1), 400(2), and the overhead tracks 500(1), 500(2), 500(3). In addition, the platform 100 also includes a motor 170 that is configured to cause the platform 100 to rotate about a vertical axis with respect to the base 200, the two launchers 800, and the launch tracks 700.

Figure 3:
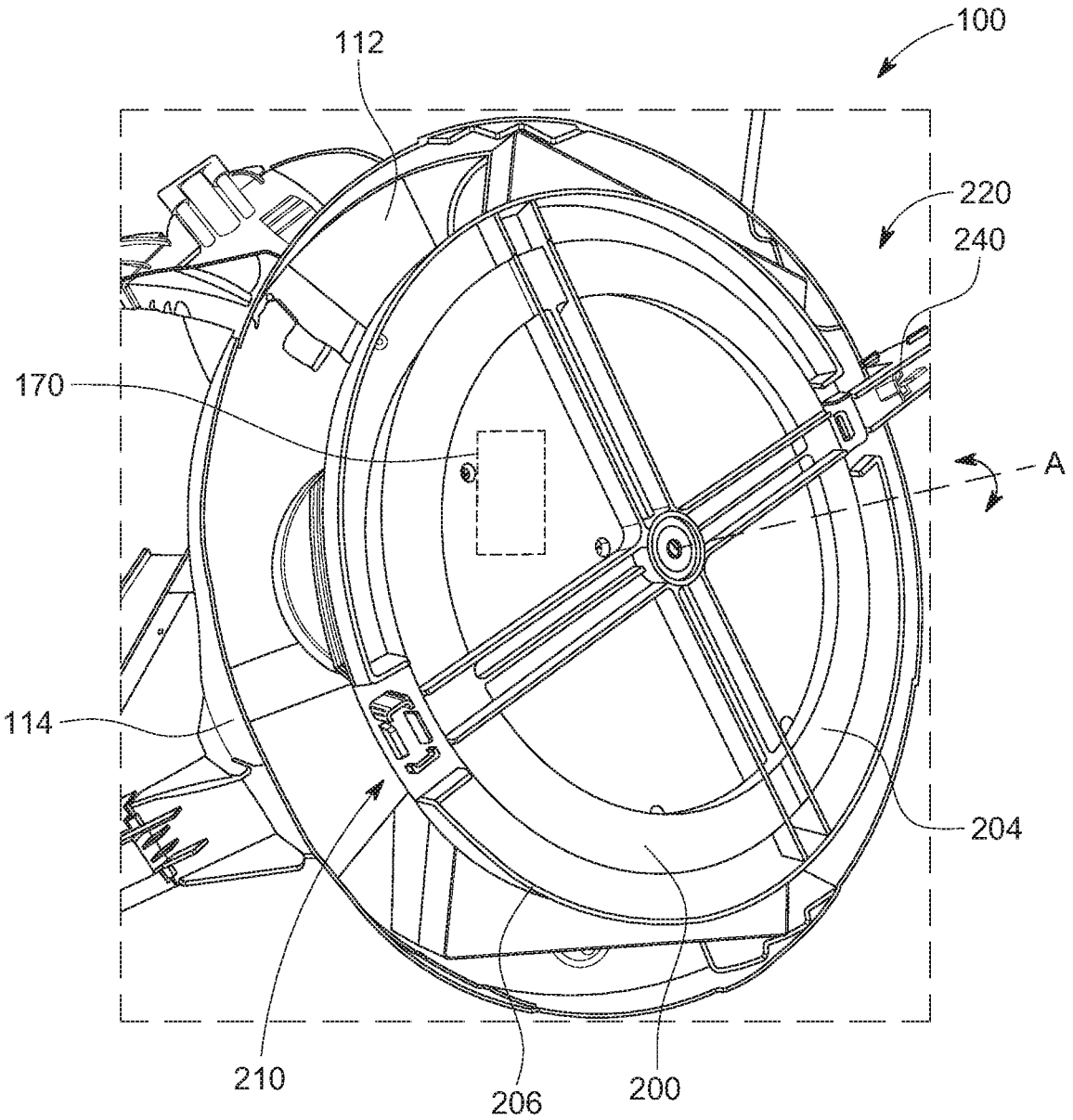
FIG. 3 illustrates a perspective view of the bottom of the platform of the embodiment of the toy vehicle playset illustrated in FIG. 2A.

As illustrated in FIGS. 2A, 2B, and 3, the platform 100 includes a top surface 110, an opposite bottom surface 112, and a sidewall 114 spanning between the top and bottom surfaces 110, 112. The platform 100 is substantially cylindrical or disc-shaped. Disposed within the top surface 110 is a first track or first track section 120 and a second track or second track section 130. More specifically, the first and second tracks 120, 130 are formed as depressions within the top surface 110 of the platform 100, where the first and second tracks 120, 130 intersect one another at an intersection location 140. Thus, as illustrated in FIGS. 2A and 2B, the first and second tracks 120, 130 form an X-shaped pattern in the top surface 110 of the platform 100. The first track 120 extends across the top surface 110 of the platform 100 between the first ramps 300(1), 300(2). The second track 130 extends across the top surface 110 of the platform 100 between the second ramps 400(1), 400(2). As further detailed below, the platform 100 further includes a booster mechanism 150 that is configured to propel toy vehicles 900 along the first and second tracks 120, 130, the ramps 300(1), 300(2), 400(1), 400(2), and the overhead tracks 500(1), 500(2), 500(3).

As further illustrated in FIGS. 2A, 2B, and 3, a motor 170 is disposed within the platform 100. The motor 170 is operatively or mechanically coupled to the booster mechanism 150 and the base 200 of the toy vehicle playset 10. The motor 170 may be operatively or mechanically coupled to the booster mechanism 150 and the base 200 via a gear train or any other mechanism. In another embodiment, the toy vehicle playset 10 may include a plurality of motors, one to independently drive the booster mechanism 150 and one to independently rotate the platform 100 with respect to the base 200.

Illustrated in FIG. 3 is the bottom surface 112 of the platform 100. Furthermore, rotatably coupled to the bottom surface 112 of the platform 100 is the base 200. The base 200 includes a top surface 202 (not illustrated), an opposite bottom surface 204, and edge 206. While the embodiment of the base 200 illustrated in FIG. 3 is substantially circular, the base 200 may be of any suitable shape. The top surface 202 of the base 200 is rotatably coupled to the bottom surface 112 of the platform 100 such that the platform 100 rotates about axis A with respect to the base 200. Furthermore, the motor 170 disposed within the platform 100 may be mechanically or operatively coupled to the top surface 202 of the base 200 (i.e., via a gear train) to drive rotation of the platform 100 about axis A with respect to the base 200. In addition, the bottom surface 204 of the base 200 is configured to sit or rest upon a support surface such that the base 200 supports the platform 100 on the support surface. Thus, the bottom surface 112 of the platform 100 is not in contact with the support surface. This enables the platform 100 to rotate about axis A with respect to the base 200 when driven by the motor 170.

As further illustrated in FIG. 3, disposed in the bottom surface 204 of the base 200, and proximate to the edge 206 of the base 200, is a first attachment point 210 and a second attachment point 220. The first attachment point 210 and the second attachment point 220 are oriented opposite of one another such that the first and second attachment points 210, 220 are disposed on the bottom surface 204 of the base 200 and offset from one another by 180 degrees. The first and second attachment points 210, 220 are configured to receive track connector arms 240. As further illustrated in FIG. 3, a track connector arm 240 is coupled to the base 200 at the second attachment point 220, while the first attachment point 210 is exposed and uncoupled from a track connector arm 240.

Turning to FIGS. 4A, 4B, 4C, 4D, and 4E, illustrated is the attachment of the track connector arm 240 to the second attachment point 220 of the base 200. While FIGS. 4A and 4B only illustrate the second attachment point 220 of the of the base 200, the discussion of FIGS. 4A and 4B and of the second attachment point 220 applies to the first attachment point 210, as the attachment points 210, 220 are identical to one another. In addition, while FIGS. 4A, 4C, 4D, and 4E only illustrate one track connector arm 240, the discussion of FIGS. 4A, 4C, 4D, and 4E and of the track connector arm 240 applies to any other track connector arm 240 configured to attach to any of the attachment points 210 because the first and second attachment points 210, 220 are identical to one another and are configured to receive the same types of track connector arms 240.

Figure 4A:
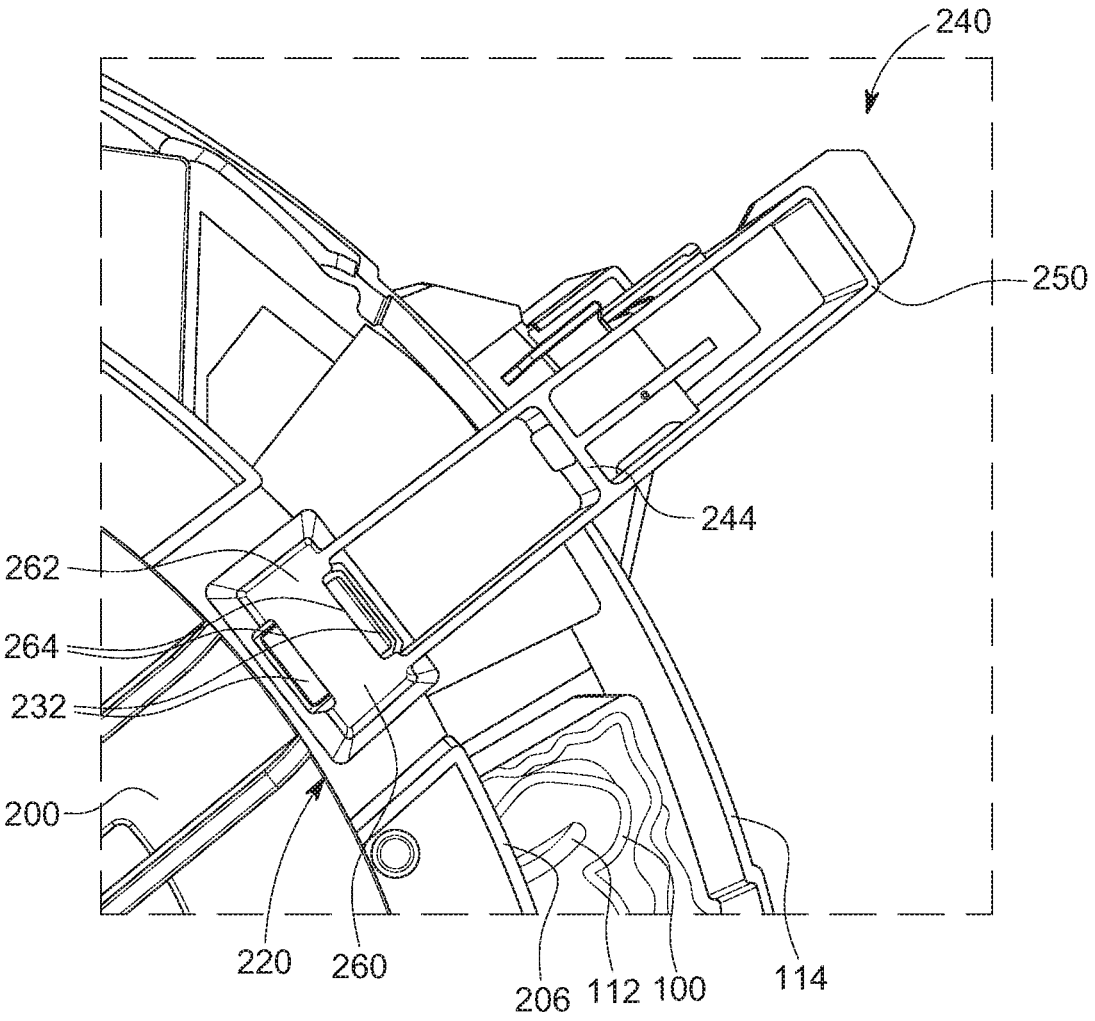
FIG. 4A illustrates a bottom view of the track connector arm of the platform of the embodiment of the toy vehicle playset illustrated in FIG. 2A.

The track connector arm 240 is generally elongated with a first end 250 and an opposite second end 260. The track connector arm 240 further includes a top surface 242 and a bottom surface 244. As best illustrated in FIG. 4A, the second end 260 of the track connector arm 240 is coupled to the base 200. When coupled to the base 200 via the second attachment point 220, the track connector arm 240 extends outwardly beyond the edge 206 of the base 200. Furthermore, the track connector arm 240 also extends beyond the platform 100, such that first end 250 of the track connector arm 240 is disposed beyond the sidewall 114 of the platform 100.

Figure 4B:
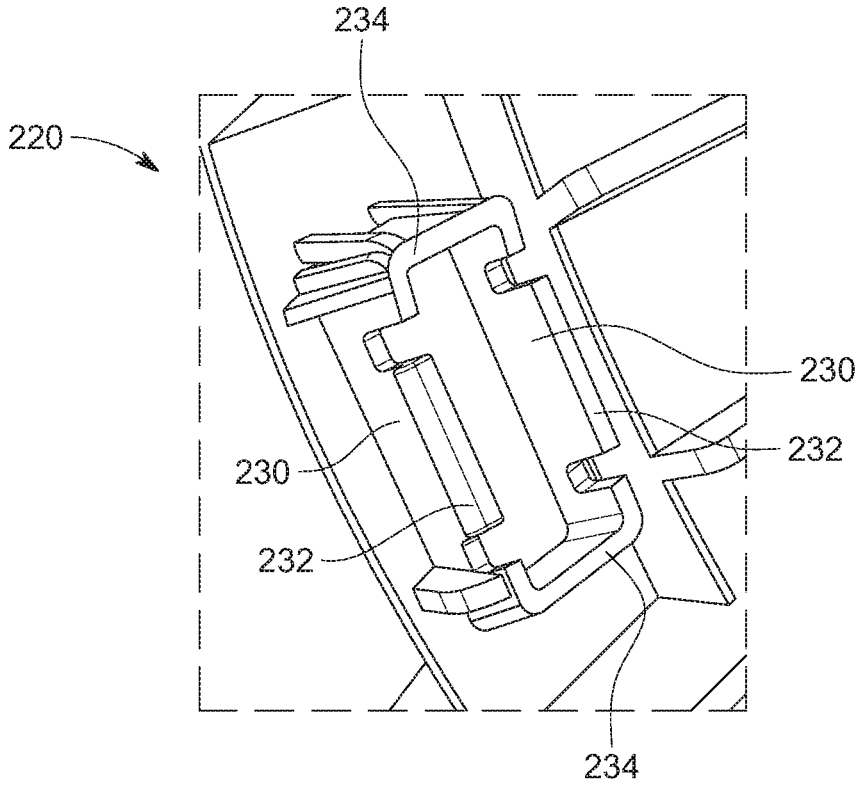
FIG. 4B illustrates an overhead perspective view of the attachment point of the bottom of the platform of the embodiment of the toy vehicle playset illustrated in FIG. 2A.

As illustrated in FIG. 4B, the attachment point 220 includes a pair of tabs 230 disposed between a pair of end walls 234. Each of the tabs 230 includes a flange 232 disposed on the end of each of the tabs 230. Moreover, the tabs 230 are configured to bend or flex with respect to the end walls 234.

Figure 4C:
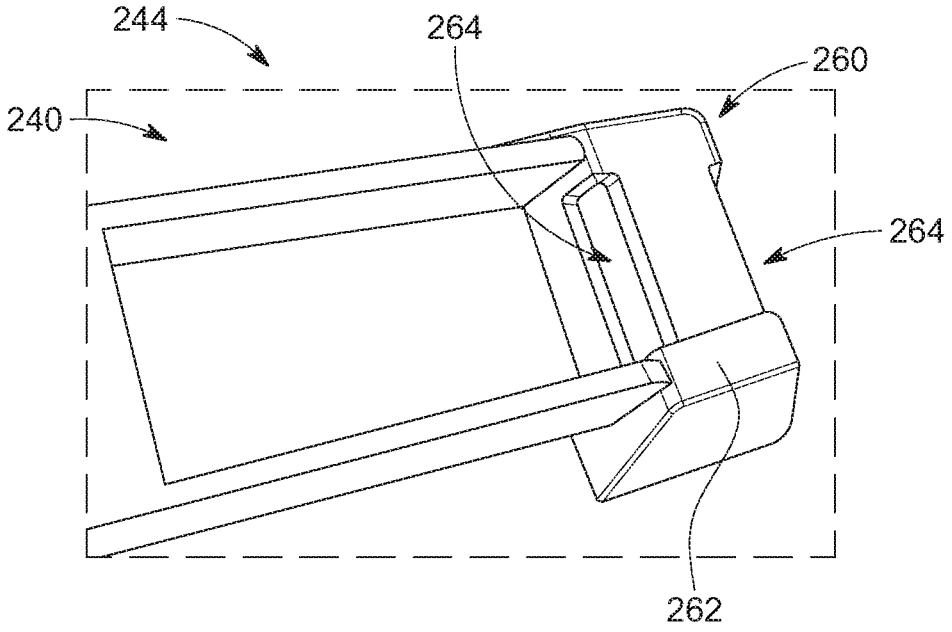
FIG. 4C illustrates an overhead perspective view of the end of the embodiment of the track connector arm illustrated in FIG. 4A.

As illustrated in FIG. 4C, the second end 260 of the track connector arm 240 includes a receptacle 262. The receptacle 262 is shaped and sized to receive one of the attachment points 210, 220 of the base 200. Moreover, the receptacle 262 includes a pair of slots 264 disposed on opposite sides of the receptacle 262. The slots 264 are shaped and sized to receive the flanges 232 of the tabs 230 of the attachment points 210, 220. To couple the track connector arm 240 to one of the attachment points 210, 220, the receptacle 262 of the track connector arm 240 is placed over one of the attachment points 210, 220 and pressed onto one of the attachment points 210, 220 until the flanges 232 snap into the slots 264 of the receptacle 262 of the second end 260 of the track connector arm 240, as best illustrated in FIG. 4A.

Figure 4D:
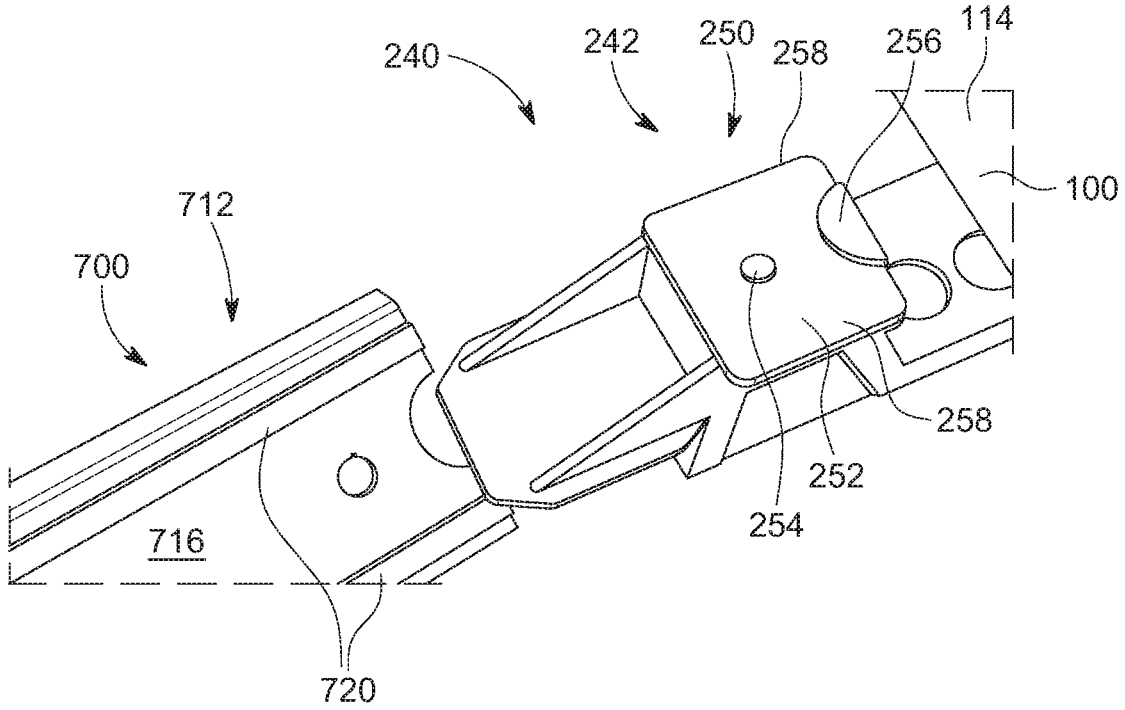
FIG. 4D illustrates a top view of embodiment of the track connector arm illustrated in FIG. 4A.
Figure 4E:
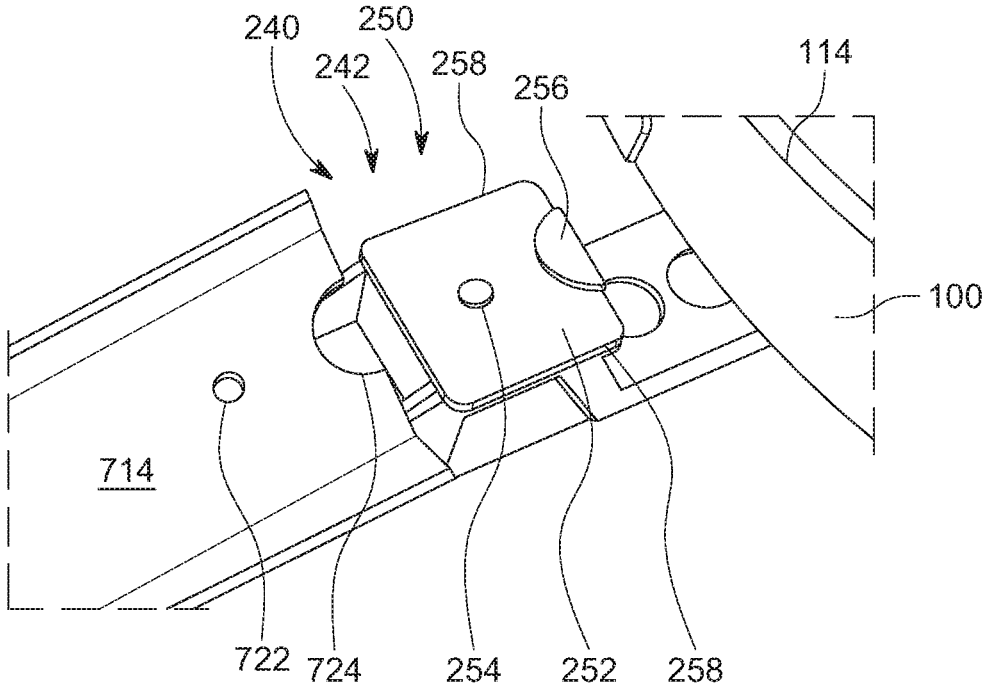
FIG. 4E illustrates a top view of a track being connected to the end of the embodiment of the track connector arm illustrated in FIG. 4A.

FIGS. 4D and 4E illustrate the top surface 242 of the first end 250 of the track connector arm 240 coupled to the base 200 and extending beyond the platform 100. As illustrated, disposed on the top surface 242 of the first end 250 of the track connector arm 240 is a receiver 252. As illustrated, the receiver 252 includes a locking member 254, an alignment member 256, and a pair of tabs 258 on the sides of the receiver 252. The receiver 252 is configured to receive the end of a track member 700. As further illustrated in FIGS. 4D and 4E, the second end 712 of the launch tracks 700 includes a top surface 714, and a bottom surface 716. Disposed on the bottom surface 716 of the launch tracks 700 is a pair of receiving slots 720 that are spaced the same distance apart as the pair of tabs 258 of the receiver 252 of the first end 250 of the track connector arm 240. Moreover, the second end 712 of the launch tracks 700 also includes a depression 724 disposed within the second end 712 and an aperture 722 disposed proximate to, but spaced from, the depression 724. To removably couple the second end 712 of a launch track 700 to the track connector arm 240, the second end 712 of the launch track 700 is slid onto the receiver 252 of the track connector arm 240 such that the tabs 258 of the receiver 252 are received by the receiving slots 720. The second end 712 of the launch track 700 is slid onto the receiver 752 until the alignment member 256 of the receiver 752 is disposed within the depression 724 of the second end 712 of the launch track 700 and the locking member 254 of the receiver 752 is received by the aperture 722 of the second end 712 of the launch track 700.

As previously explained, and as illustrated in FIGS. 2A and 2B, disposed on the platform 100 is a pair of first ramps 300(1), 300(2), where the first ramps 300(1), 300(2) are disposed on the top surface 110 of the platform 100 proximate to the sidewalls 114 of the platform 100. Furthermore, the first ramps 300(1), 300(2) are oriented along the platform 100 such that the first ramps 300(1), 300(2) are opposite of one another. Moreover, the first track 120 of the platform 100 extends between first ramp 300(1) and first ramp 300(2).

Figure 5A:
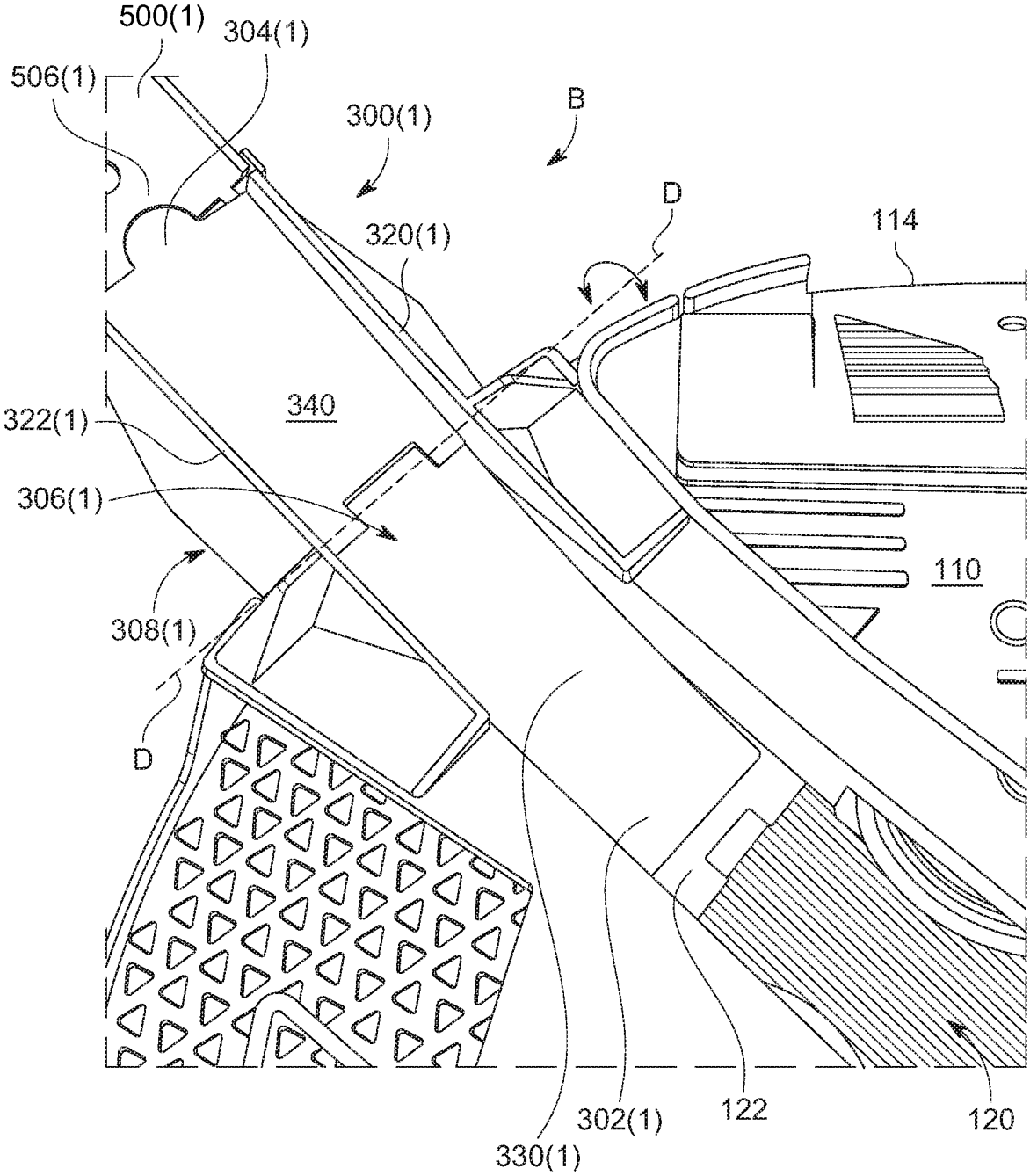
FIG. 5A illustrates a top view of the front side of a first ramp type for the embodiment of the toy vehicle playset illustrated in FIG. 1, the first ramp type being equipped with a door that is disposed in the closed position.
Figure 5B:
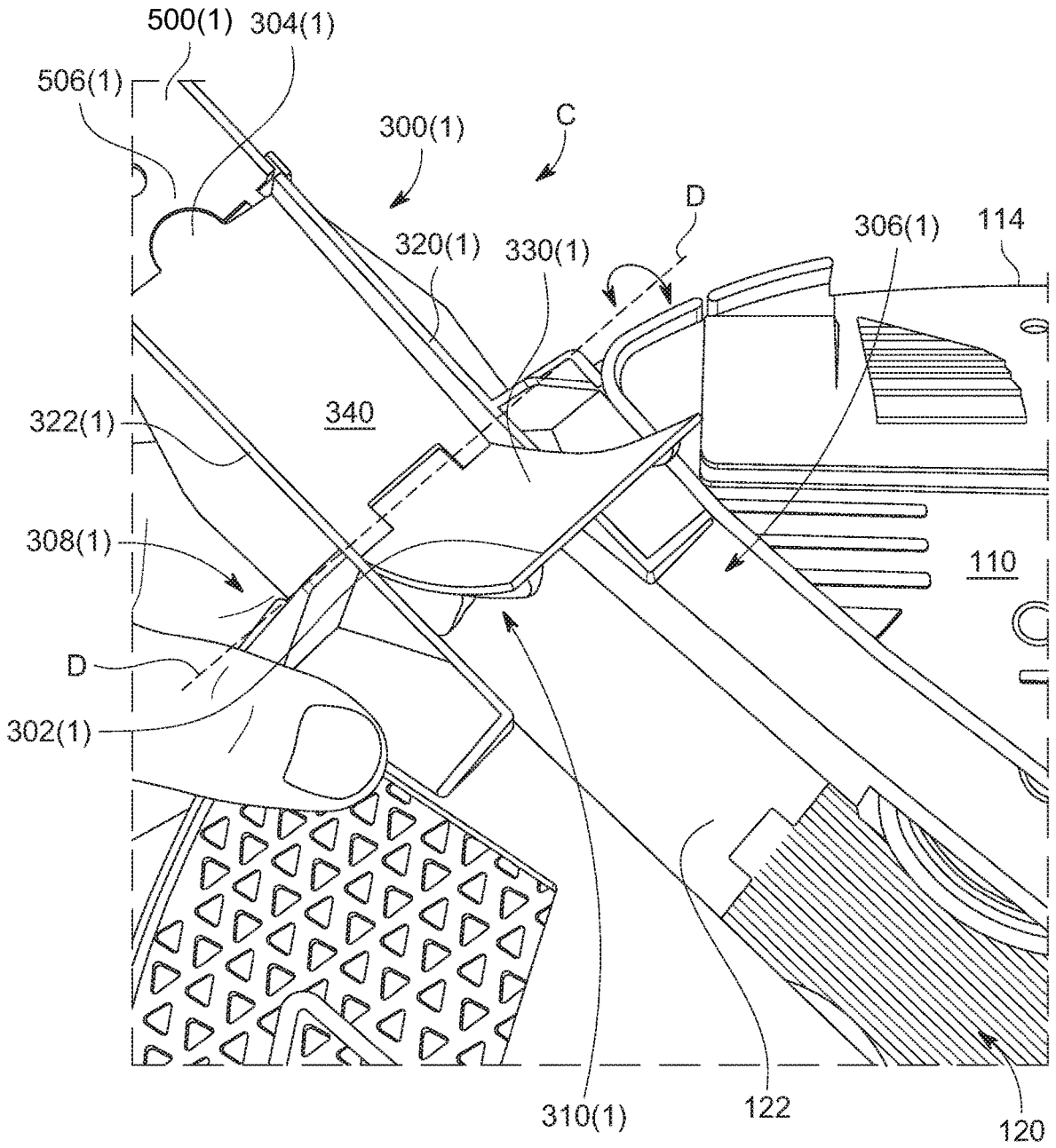
FIG. 5B illustrates a top view of the front side of the first ramp type illustrated in FIG. 5A for the embodiment of the toy vehicle playset illustrated in FIG. 1, the first ramp type being equipped with a door that is disposed in the opened position.

Turning to FIGS. 5A and 5B, illustrated is detailed view of the first ramp 300(1) of the platform 100. The first ramp 300(1) includes a lower end 302(1) and an upper end 304(1). The lower end 302(1) of the first ramp 300(1) is aligned with the first end 122 of the first track 120 of the platform 100 such that the lower end 302(1) of the first ramp 300(1) is disposed within the first end 122 of the first track 120. Moreover, coupled to the upper end 304(1) of the first ramp 300(1) is the first end 506(1) of overhead track 500(1). While FIGS. 5A and 5B illustrate overhead track 500(1) being coupled to the first ramp 300(1), any of the overhead tracks 500(1), 500(2), 500(3) may be coupled to the upper end 304(1) of the first ramp 300(1).

The first ramp 300(1) further includes a front side 306(1) that faces towards the platform 100, the first track 120 of the platform 100, and the other first ramp 300(2). The first ramp 300(2) also includes a rear side 308(1) that is disposed opposite of the front side 306(1) and faces away from the platform 100. Extending between the front side 306(1) and the rear side 308(1) is a first side or sidewall 320(1) and a second side or sidewall 322(1). The first sidewall 320(1) and the second sidewall 322(1) collectively define a track or pathway 340 on the front side 306(1) of the first ramp 300(1) between the lower end 302(1) and the upper end 304(1).

It then follows that a toy vehicle 900 traveling along the overhead ramp 500(1) would travel past the upper end 304(1) onto the first ramp 300(1), and continue onto the first track 120 of the platform 100 via the lower end 302(1) of the first ramp 300(1). Conversely, a toy vehicle 900 traveling along the first track 120 of the platform 100 toward the first ramp 300(1) would enter the first ramp 300(1) at the lower end 302(1), and then continue along the first ramp 300(1) onto the overhead track 500(1) via the upper end 304(1) of the first ramp 300(1).

While FIG. 5A only illustrates first ramp 300(1), first ramp 300(2) may also have the same or similar structural characteristics such that first ramp 300(2) is nearly identical to first ramp 300(1). However, first ramp 300(1) may differ from first ramp 300(2) in that first ramp 300(1) may further include a door 330(1) disposed within the track 340 of first ramp 300(1), while first ramp 300(2) may not contain a door. While not illustrated, first ramp 300(1) may further differ from the first ramp 300(2) in that first ramp 300(1) may include an entry opening 310(1) disposed on the rear side 308(1) of the first ramp 300(1).

The door 330(1) of the first ramp 300(1) is formed as a portion of the lower end 302(1) of the first ramp 300(1). The door 330(1) is reconfigurable between a closed position B, illustrated in FIG. 5A, and an opened position C, illustrated in FIG. 5B. The door 330(1) rotates about axis D, which is located between the upper end 304(1) and the lower end 302(1) of the first ramp 300(1). When in the closed position B, the lower end 302(1) of the first ramp 300(1) is disposed within the first track 120 of the platform 100, but when in the opened position C, the door 330(1) is rotated about the axis D such that the lower end 302(1) of the first ramp 300(1) is raised out of the first track 120 of the platform 100. The door 330(1) in the opened position C provides access to the first end 122 of the first track 120 of the platform 100 via the entry opening 310(1) disposed on the rear side 308(1) of the first ramp 300(1). As a toy vehicle 900 is propelled into the entry opening 310(1) on the rear side 308(1) of the first ramp 300(1), the toy vehicle 900 pushes the door 330(1) of the first ramp 300(1) from the closed position B to the opened position C, which enables the toy vehicle 900 to continue onto the first track 120 of the platform 100.

Additionally, as previously explained, and as illustrated in FIGS. 2A and 2B, also disposed on the platform 100 is a pair of second ramps 400(1), 400(2) that differ from the pair of first ramps 300(1), 300(2). Like the first ramps 300(1), 300(2), the pair of second ramps 400(1), 400(2) are disposed on the top surface 110 of the platform 100 proximate to the sidewalls 114 of the platform 100. Furthermore, the second ramps 400(1), 400(2) are oriented along the platform 100 such that the second ramps 400(1), 400(2) are oriented opposite of one another. As illustrated in FIGS. 2A and 2B, the second ramps 400(1), 400(2) may be offset approximately 90 degrees from the first ramps 300(1), 300(2) along the sidewall 114 of the platform 100. Moreover, the second track 130 of the platform 100 extends between second ramp 400(1) and second ramp 400(2).

Turning to FIGS. 6A, 6B, 6C, and 6D, illustrated is detailed view of the second ramp 400(1) of the platform 100. The second ramp 400(1) includes a first end 402(1), a second end 404(1), and a third end 406(1). The first end 402(1) is located at the lower end of the second ramp 400(1) such that the first end 402(1) of the second ramp 400(1) is aligned with the first end 132 of the second track 130 of the platform 100. More specifically, the lower end 402(1) of the second ramp 400(1) is disposed within the first end 122 of the second track 130. Furthermore, the second and third ends 404(1), 406(1) of the second ramp 400(1) are located at the upper end of the second ramp 400(1) such that the second and third ends 404(1), 406(1) are disposed above the top surface 110 of the platform 100. Coupled to the second end 404(1) of the second ramp 400(1) is overhead track 500(2), while the third end 406(1) of the second ramp 400(1) is coupled to overhead track 500(3). While FIGS. 5A and 5B illustrate overhead tracks 500(2), 500(3) being coupled to the second ramp 400(1), any of the overhead tracks 500(1), 500(2), 500(3) may be coupled to the second and third ends 404(1), 406(1) of the second ramp 400(1).

Figure 6A:
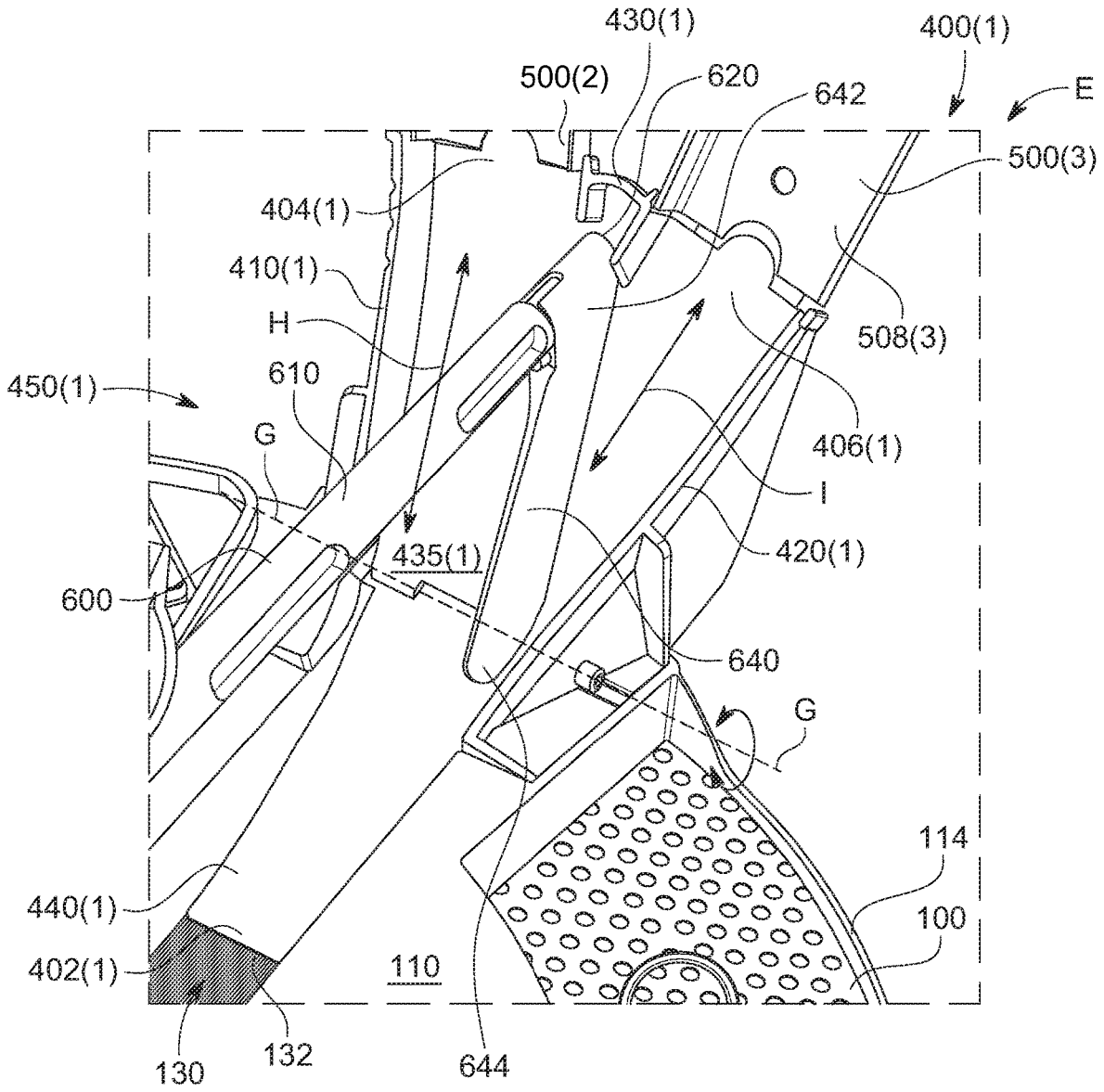
FIG. 6A illustrates a perspective view of the front side of a second ramp type for the embodiment of the toy vehicle playset illustrated in FIG. 1, the second ramp type being equipped with a door that is disposed in the closed position.
Figure 6B:
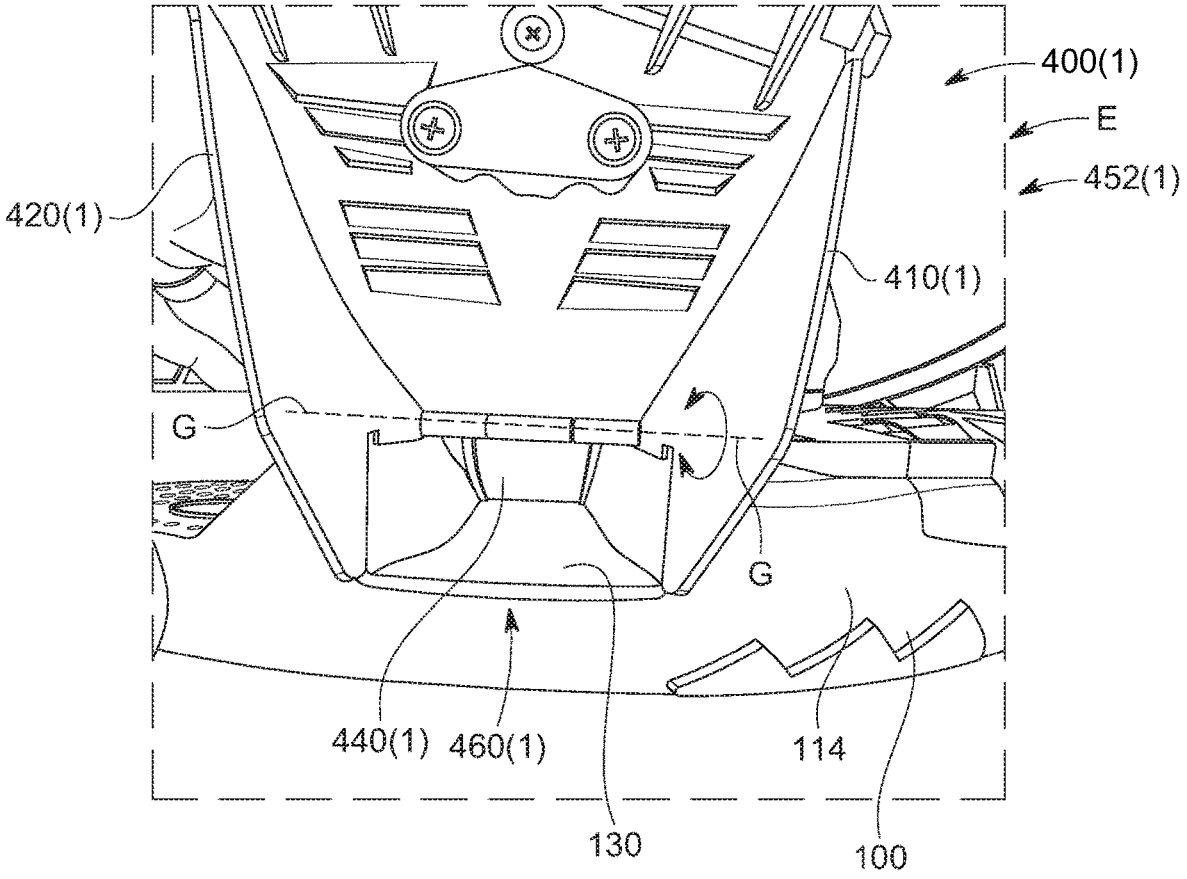
FIG. 6B illustrates a rear elevational view of the second ramp type illustrated in FIG. 6A for the embodiment of the toy vehicle playset illustrated in FIG. 1, the second ramp type being equipped with a door that is disposed in the closed position.
Figure 6C:
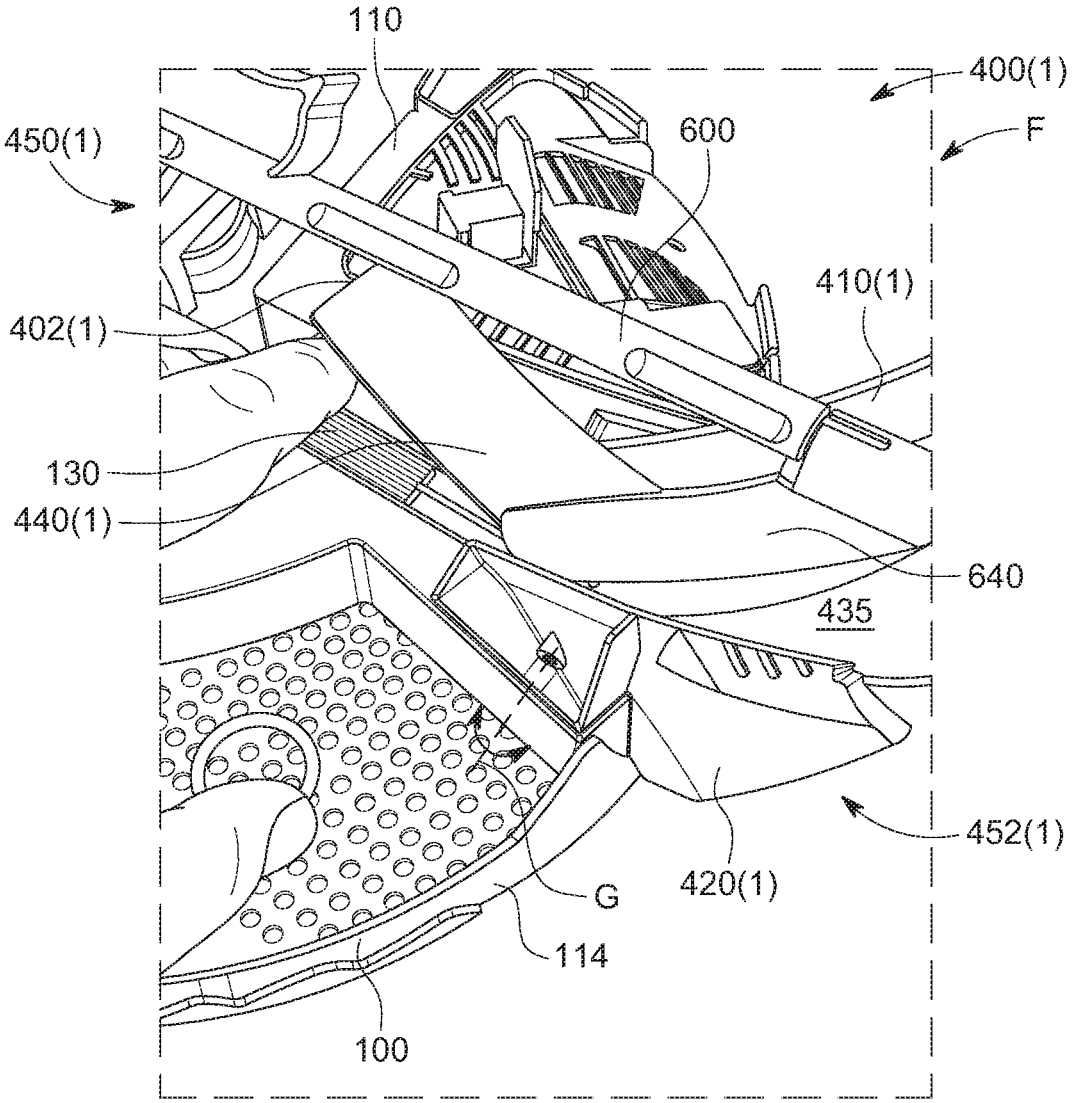
FIG. 6C illustrates a perspective view of the front side of the second ramp type illustrated in FIG. 6A for the embodiment of the toy vehicle playset illustrated in FIG. 1, the second ramp type being equipped with a door that is disposed in the open position.
Figure 6D:
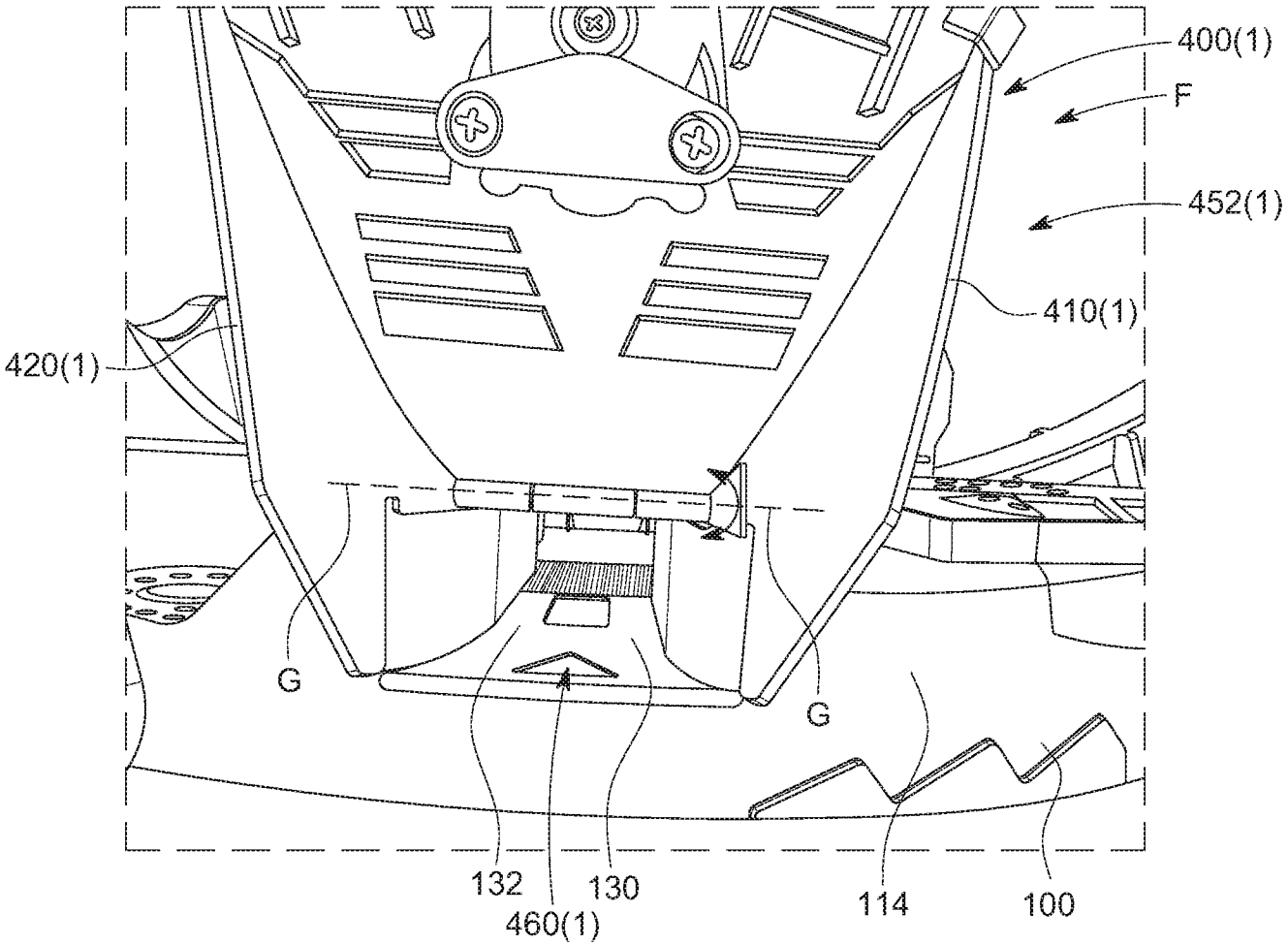
FIG. 6D illustrates a rear elevational view of the second ramp type illustrated in FIG. 6A for the embodiment of the toy vehicle playset illustrated in FIG. 1, the second ramp type being equipped with a door that is disposed in the open position.

The second ramp 400(1) further includes a front side 450(1), as illustrated in FIGS. 6A and 6C, that faces towards the platform 100, the second track 130 of the platform 100, and the other second ramp 400(2). The second ramp 400(2) also includes a rear side 452(1), as illustrated in FIGS. 6B and 6D, that is disposed opposite of the front side 450(1) and faces away from the platform 100. The second ramp 400(1) further includes a first side or sidewall 410(1) and a second side or sidewall 420(1). As further illustrated in FIG. 6A, an intermediate sidewall or portion 430(1) is disposed between the second end 404(1) and the third end 406(1). The first sidewall 410(1), the second sidewall 420(1), and the intermediate sidewall 430(1) collectively define a track 435(1) on the front side 450(1) of the second ramp 400(1), where the track 435(1) defines a first pathway H and a second pathway I. First pathway H extends along the first sidewall 410(1) between the first end 402(1) and the second end 404(1), while the second pathway I extends along the second sidewall 420(1) between the first end 402(1) and the third end 406(1).

As further illustrated in FIG. 6A, and as further explained below, the repositionable diverter mechanism 600 is coupled to the second ramp 400(1) such that the first diverter paddle 640 of the diverter mechanism 600 is disposed and repositionable within the track 435(1) of the second ramp 400(1). The positioning of the first diverter paddle 640 within the track 435(1) of the second ramp 400(1) determines which pathway H, I a toy vehicle 900 traveling over the second ramp 400(1) would take. Thus, when the diverter paddle 640 is positioned to be adjacent or in abutment with the second sidewall 420(1), a toy vehicle 900 would travel over the second ramp 400(1) along pathway H. It then follows that a toy vehicle 900 traveling along the second track 130 of the platform 100 toward the second ramp 400(1) would enter the second ramp 400(1) at the first end 402(1), and continue along pathway H of the second ramp 400(1) onto the overhead track 500(2) via the second end 404(1) when the diverter paddle 640 is in abutment with the second sidewall 420(1). Conversely, when the diverter paddle 640 is positioned to be adjacent or in abutment with the first sidewall 410(1), a toy vehicle 900 would travel over the second ramp 400(1) along pathway I. It then follows that a toy vehicle 900 traveling along the second track 130 of the platform 100 toward the second ramp 400(1) would enter the second ramp 400(1) at the first end 402(1), and continue along pathway I of the second ramp 400(1) onto the overhead track 500(3) via the third end 406(1) when the diverter paddle 640 is in abutment with the first sidewall 410(1).

While FIG. 6A only illustrates the second ramp 400(1), second ramp 400(2) may also have the same or similar structural characteristics such that second ramp 400(2) is nearly identical to second ramp 400(1). However, second ramp 400(1) may differ from second ramp 400(2) in that second ramp 400(1) may further include a door 440(1) disposed within the track 435(1) of second ramp 400(1), while second ramp 400(2) does not contain a door. Second ramp 400(1) may further differ from the second ramp 400(2) in that second ramp 400(1) may include an entry opening 460(1) disposed on the rear side 452(1) of the second ramp 400(1), as illustrated in FIGS. 6B and 6D.

The door 440(1) of the second ramp 400(1) is formed as a portion of the lower end of the second ramp 400(1), where the door 440(1) forms part of the first end 402(1) of the second ramp 400(1). The door 440(1) is reconfigurable between a closed position E, illustrated in FIGS. 6A and 6B, and an opened position F, illustrated in FIGS. 6C and 6D. The door 440(1) rotates about axis G between the closed position E and the opened position F, where the axis G is located between the first end 402(1) and the second and third ends 404(1), 406(1) of the second ramp 400(1). In addition, the entry opening 460(1) is disposed on the rear side 452(1) of the second ramp 400(1) proximate to the second track 130 of the platform 100 and sidewall 114 of the platform 100. The entry opening 460(1) may be at least partially formed or defined by the portions of the first sidewall 410(1) and the second sidewall 420(1) that are disposed on the rear side 452(1) of the second ramp 400(1).

When in the closed position E, the first end 402(1) of the second ramp 400(1) is disposed within the second track 130 of the platform 100. Moreover, as best illustrated in FIG. 6B, the door 440(1) in the closed position E prevents access to the second track 130 of the platform 100 via the entry opening 460(1). When the door 440(1) is in the opened position F, however, the door 440(1) is rotated about the axis G such that the first end 402(1) of the second ramp 400(1) is raised out of the second track 130 of the platform 100. As best illustrated in FIGS. 6C and 6D, the door 440(1) in the opened position F provides access to the first end 132 of the second track 130 of the platform 100 via the entry opening 460(1) disposed on the rear side 452(1) of the second ramp 400(1). Thus, as a toy vehicle 900 is propelled into the entry opening 460(1) on the rear side 452(1) of the second ramp 400(1), the toy vehicle 900 pushes the door 440(1) of the second ramp 400(1) from the closed position E to the opened position F, where the toy vehicle 900 continues onto the second track 130 of the platform 100.

Turning back to FIGS. 2A and 2B, the overhead tracks 500(1), 500(2), 500(3) are interconnected between the first ramps 300(1), 300(2) and the second ramps 400(1), 400(2). As illustrated in FIGS. 2A and 2B, each of the overhead tracks 500(1), 500(2), 500(3) includes a first surface 502(1), 502(2), 502(3) and an opposite second surface 504(1), 504(2), 504(3). The first surfaces 502(1), 502(2), 502(3) may be configured to enable a toy vehicle 900 to travel along the first surfaces 502(1), 502(2), 502(3). The overhead tracks 500(1), 500(2), 500(3) are substantially linear, where each includes a first end 506(1), 506(2), 506(3) and an opposite second end 508(1), 508(2), 508(3). FIGS. 2A and 2B illustrate that overhead track 500(1) is coupled to the first ramp 300(1) and the second ramp 400(2) to create a pathway between the first ramp 300(1) and the second ramp 400(2). More specifically, the first end 506(1) of overhead track 500(1) is coupled to the first ramp 300(1), while the second end 508(1) of overhead track 500(1) is coupled to the second ramp 400(2). Furthermore, overhead track 500(2) is coupled to both of the second ramps 400(1), 400(2) to create a second pathway between the second ramps 400(1), 400(2) (i.e., second track 130 of the platform 100 is a first pathway between second ramps 400(1), 400(2), overhead track 500(2) is an inverted second pathway between second ramps 400(1), 400(2) that is raised above the top surface 110 of the platform 100). As illustrated, the first end 506(2) of overhead track 500(2) is coupled to the second ramp 400(2), while the second end 508(2) of overhead track 500(2) is coupled to the second ramp 400(1). In addition, overhead track 500(3) is coupled to the first ramp 300(2) and the second ramp 400(1) to create a pathway between the first ramp 300(2) and the second ramp 400(1). More specifically, the first end 506(3) of overhead track 500(3) is coupled to the first ramp 300(2), while the second end 508(3) of overhead track 500(3) is coupled to the second ramp 400(1).

FIGS. 2A and 2B further illustrate connection member 510(1), 510(2) that are coupled between the overhead tracks 500(1), 500(2), 500(3). Connection member 510(1) includes a first end 512(1) and a second end 514(1). First end 512(1) of connection member 510(1) is coupled to the second surface 504(1) of overhead track 500(1), while second end 514(1) of connection member 510(1) is coupled to the second surface 504(2) of overhead track 500(2). Similarly, connection member 510(2) also includes a first end 512(2) and a second end 514(2). Furthermore, first end 512(2) of connection member 510(2) is coupled to the second surface 504(2) of overhead track 500(2), while second end 514(2) of connection member 510(2) is coupled to the second surface 504(3) of overhead track 500(3). Connection members 510(1), 510(2) are configured to provide stability and support to the overhead tracks 500(1), 500(2), 500(3) as a toy vehicle 900 travels along the first surfaces 502(1), 502(2), 502(3) of the overhead tracks 500(1), 500(2), 500(3).

It is to be appreciated that any number of overhead tracks may be utilized to couple the ramps 300(1), 300(2), 400(1), 400(2) to one another. It is to be further appreciated that the overhead tracks 500(1), 500(2), 500(3) may be coupled to the ramps 300(1), 300(2), 400(1), 400(2) in other configurations that differ from that illustrated in FIGS. 2A and 2B.

Figure 7A:
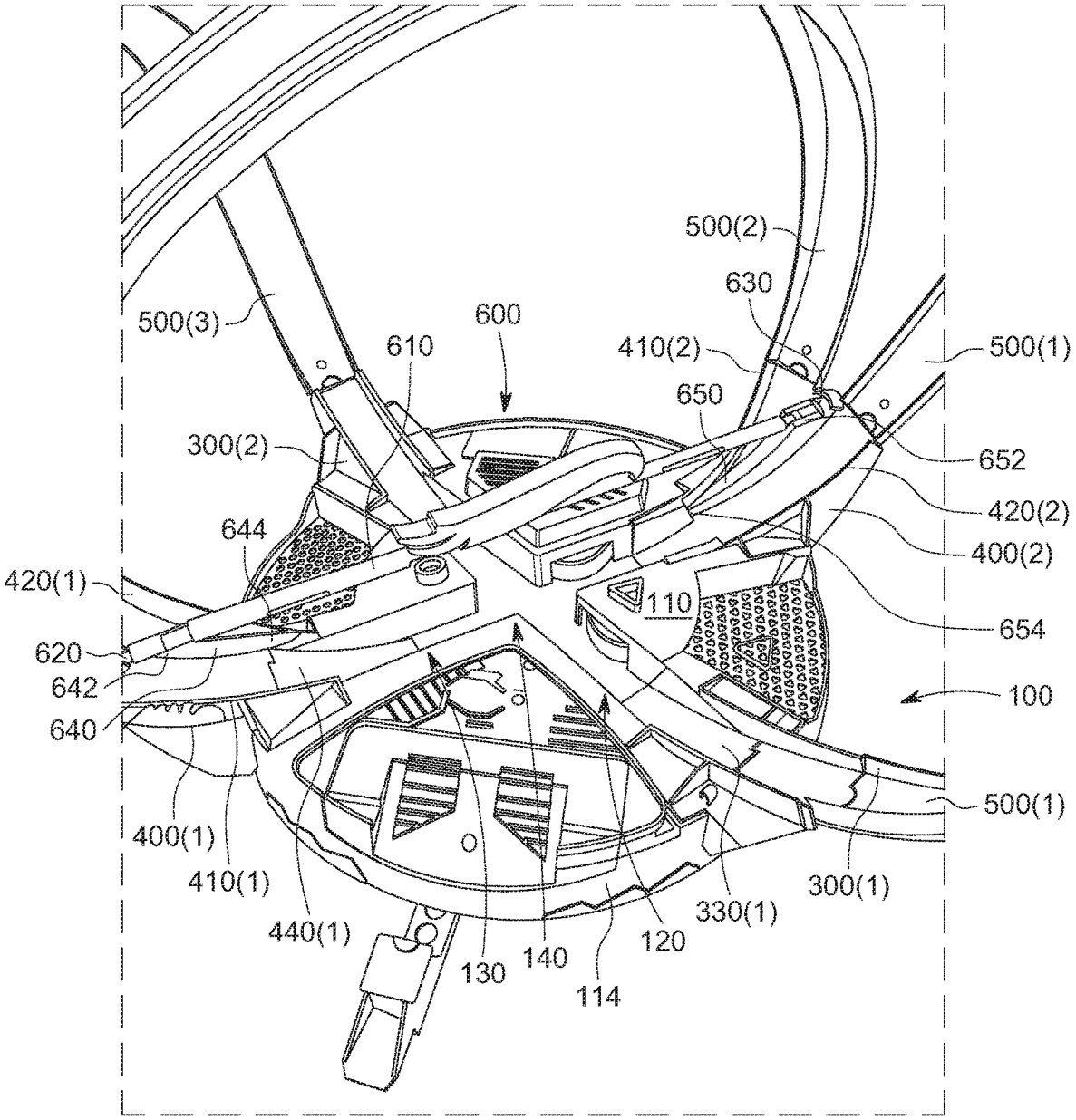
FIG. 7A illustrates a perspective view of the diverter mechanism of the platform of the embodiment of the toy vehicle playset illustrated in FIG. 1.
Figure 7B:
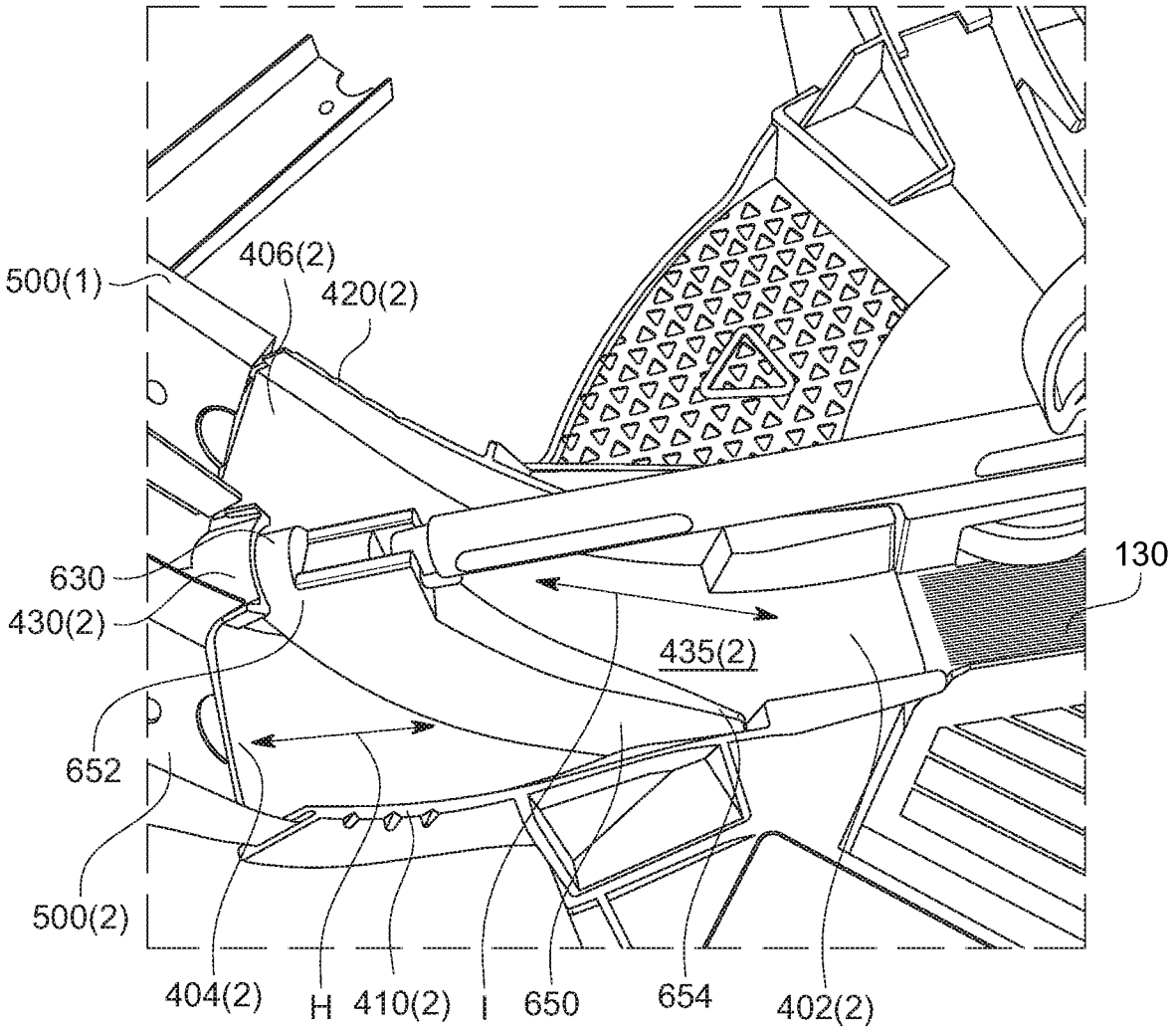
FIG. 7B illustrates a top view of the first end of the diverter mechanism illustrated in FIG. 7A.

Turning to FIGS. 6A, 7A, 7B, 7C, and 7D, illustrated are detailed views of the diverter mechanism 600 that extends between the second ramps 400(1), 400(2). As best illustrated in FIG. 7A, the diverter mechanism 600 includes a crossbar 610 with a first end 620 and a second end 630. The first end 620 of the crossbar 610 is rotatably coupled to the second ramp 400(1), while the second end 630 of the crossbar 610 is rotatably coupled to the second ramp 400(2). As illustrated in FIGS. 6A and 7A, the first end 620 of the crossbar 610 includes a first diverter paddle 640, where the first diverter paddle 640 includes a proximal end 642 and a distal end 644. The proximal end 642 of the first diverter paddle 640 is coupled to the first end 620 of the crossbar 610, while the distal end 644 is disposed within the track 435(1) of the second ramp 400(1). As illustrated in FIGS. 7A and 7B, the second end 630 of the crossbar 610 includes a second diverter paddle 650, where the second diverter paddle 650 includes a proximal end 652 and the distal end 654. Like the first diverter paddle 640, the proximal end 652 of the second diverter paddle 650 is coupled to the second end 630 of the crossbar 610, while the distal end 654 is disposed within the track 435(2) of the second ramp 400(2).

Figure 7C:
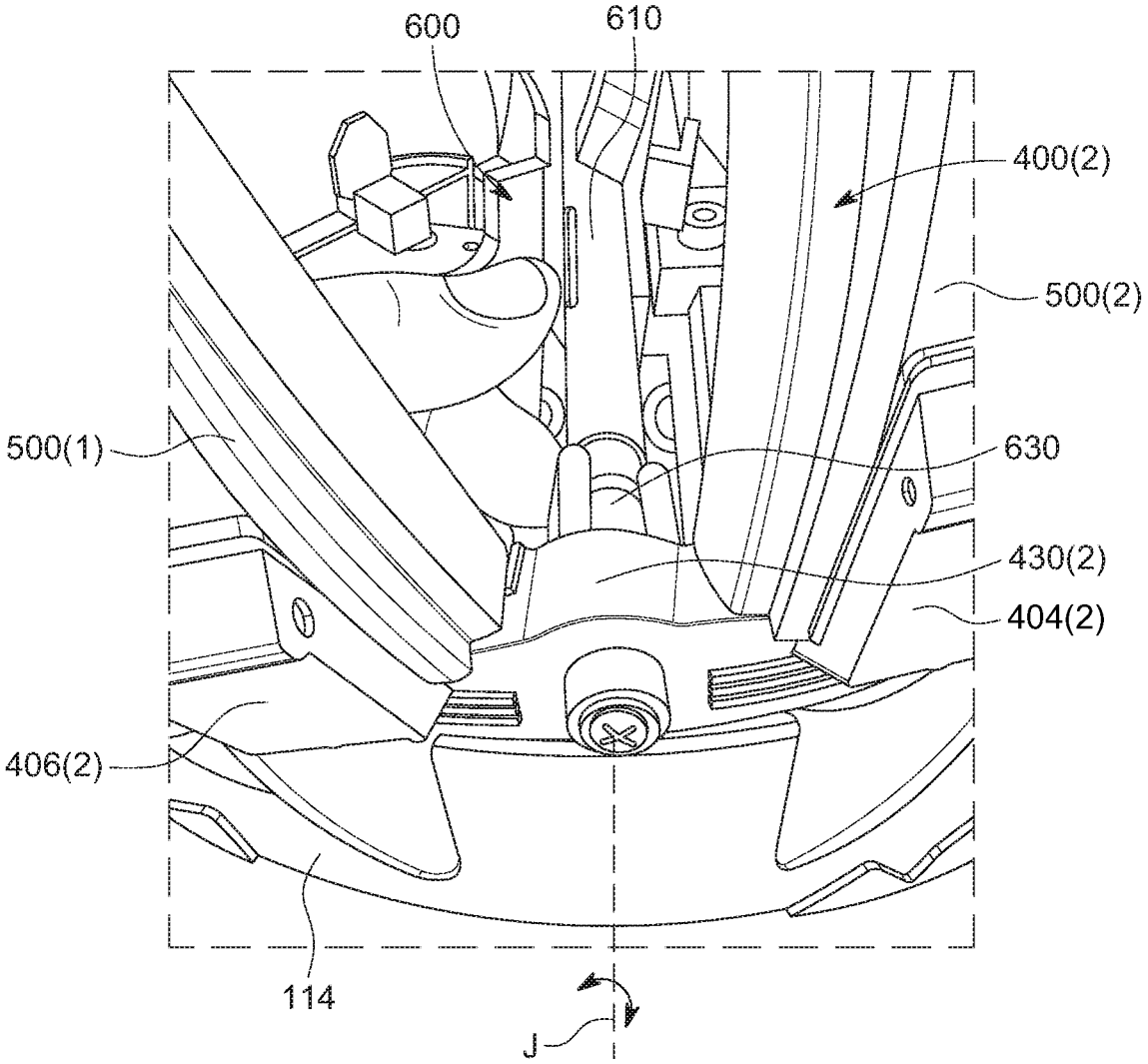
FIG. 7C illustrates a perspective view of the connection of the first end of the diverter mechanism illustrated in FIG. 7A to one of the ramps of the platform of the embodiment of the toy vehicle playset illustrated in FIG. 1.
Figure 7D:
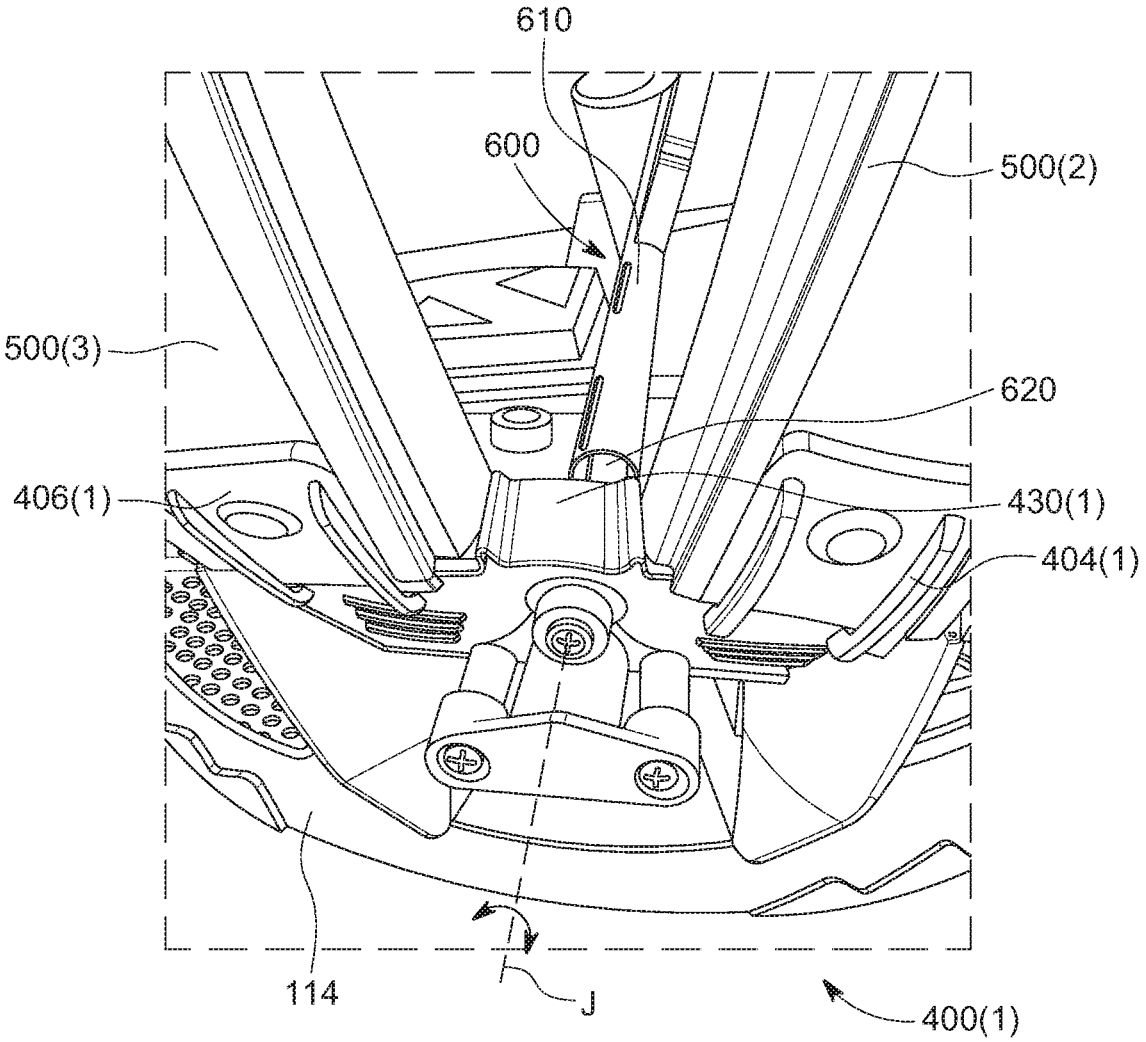
FIG. 7D illustrates a side elevational view of the connection of the second end of the diverter mechanism illustrated in FIG. 7A to one of the ramps of the platform of the embodiment of the toy vehicle playset illustrated in FIG. 1.

As further illustrated in FIGS. 7C and 7D, the crossbar 610 is rotatably coupled to the second ramps 400(1), 400(2) such that the crossbar 610 is configured to rotate about axis J, which extends coaxially through the crossbar 610. As illustrated in FIG. 7C, the second end 630 of the crossbar 610 is rotatably coupled to the intermediate portion 430(2) of the second ramp 400(2), and between the second and third ends 404(2), 406(2) of the second ramp 400(2). Conversely, as illustrated in FIG. 7D, the first end 620 of the crossbar 610 is rotatably coupled to the intermediate portion 43091) of the second ramp 400(1), and between the second and third ends 404(1), 406(1) of the second ramp 400(2).

Rotation of the crossbar 610 about the rotational axis J repositions the first diverter paddle 640 within the track 435(1) of the second ramp 400(1) while simultaneously repositioning the second diverter paddle 650 within the track 435(2) of the second ramp 400(2). Because the first diverter paddle 640 and the second diverter paddle 650 are linked to each other through the crossbar 610, when the distal end 644 of the first diverter paddle 640 is disposed proximate to the second sidewall 420(1) of second ramp 400(1), the distal end 654 of the second diverter paddle 650 is disposed proximate to the first sidewall 410(1) of second ramp 400(2). In this positioning, a toy vehicle 900 traveling up second ramp 400(1) would travel along pathway H, while a toy vehicle 900 traveling up second ramp 400(2) would travel along pathway I. However, when the distal end 644 of the first diverter paddle 640 is disposed proximate to the first sidewall 410(1) of second ramp 400(1), the distal end 654 of the second diverter paddle 650 is disposed proximate to the second sidewall 420(1) of second ramp 400(2). In this positioning, a toy vehicle 900 traveling up second ramp 400(1) would travel along pathway I, while a toy vehicle 900 traveling up second ramp 400(2) would travel along pathway H. Therefore, because the first diverter paddle 640 and the second diverter paddle 650 are linked to each other through the crossbar 610, repositioning the first diverter paddle 640 simultaneously repositions the second diverter paddle 650, and vice versa. In other words, when the crossbar 610 is rotated about axis J, the first and second diverter paddles 640, 650 are simultaneously repositioned.

The repositioning, and ultimately rotation of the crossbar 610, of the first and second diverter paddles 640, 650 may occur when a toy vehicle 900 travels down one of the second ramps 400(1), 400(2). For example, when the distal end 644 of the first diverter paddle 640 is disposed proximate to the second sidewall 420(1) of second ramp 400(1) and the distal end 654 of the second diverter paddle 650 is disposed proximate to the first sidewall 410(1) of second ramp 400(2), a toy vehicle 900 traveling downwardly along pathway I on second ramp 400(1) from the third end 406(1) to the first end 402(1), or a toy vehicle 900 traveling downwardly along pathway H on second ramp 400(2) from the second end 404(2) to the first end 402(2), would cause the diverter mechanism 600, and ultimately the first and second diverter paddles 640, 650, to reposition. In another example, when the distal end 644 of the first diverter paddle 640 is disposed proximate to the first sidewall 410(1) of second ramp 400(1) and the distal end 654 of the second diverter paddle 650 is disposed proximate to the second sidewall 420(1) of second ramp 400(2), a toy vehicle 900 traveling downwardly along pathway H on second ramp 400(1) from the second end 406(1) to the first end 402(1), or a toy vehicle 900 traveling along pathway I on second ramp 400(2) from the third end 406(2) to the first end 402(2), would also cause the diverter mechanism 600, and ultimately the first and second diverter paddles 640, 650, to reposition.

Figure 8A:
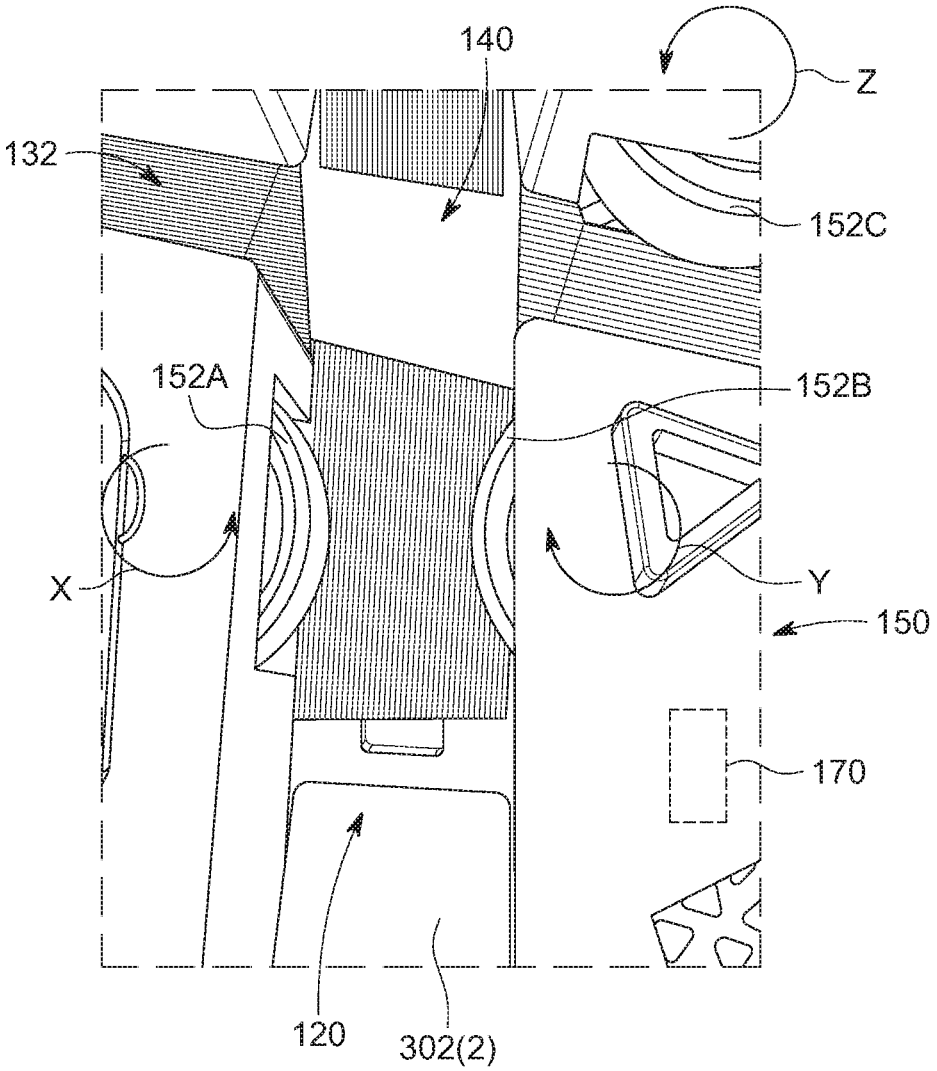
FIG. 8A illustrates a top view of the booster wheels of the platform of the embodiment of the toy vehicle playset illustrated in FIG. 2A.

Turning to FIGS. 8A, 8B, 8C, and 8D, illustrated are detailed views of the booster mechanism 150. As previously explained, the platform 100 further includes a booster mechanism 150 disposed within the top surface 110 of the platform 100. More specifically, the booster mechanism 150 at least partially protrudes into the first and second tracks 120, 130 of the platform 100 such that the booster mechanism 150 is configured to propel or accelerate toy vehicles 900 along the first and second tracks 120, 130, the ramps 300(1), 300(2), 400(1), 400(2), and the overhead tracks 500(1), 500(2), 500(3). As illustrated in FIG. 8A, the booster mechanism 150 includes three booster wheels 152A, 152B, 152C. Booster wheel 152A at least partially extends into the first track 120 of the platform 100, while booster wheel 152C extends at least partially into the second track 130 of the platform 100. Furthermore, booster wheel 152B may at least partially extend into both the first and second tracks 120, 130 of the platform 100. The booster wheels 152A, 152B, 152C are configured to extend far enough into the first and second tracks 120, 130 of the platform 100 such that the booster wheels 152A, 152B, 152C contact a toy vehicle 900 traveling along either of the first and second tracks 120, 130 of the platform.

FIG. 8B shows booster wheel 152A in more detail. Although not required in all embodiments, booster wheel 152A includes a wheel gear 154 and a central support 156. The booster wheel 152A also includes a thin-walled member 158 used to make contact with the toy vehicle 900 and accelerate it forward along the first track 120 of the platform 100. FIGS. 8C and 8D show a cross-section of a portion of thin-walled member 158. While FIGS. 8B, 8C, and 8D only illustrate the booster wheel 152A, the discussion of FIGS. 8B, 8C, and 8D, and of the booster wheel 152A applies to booster wheels 152B and 152C, as the booster wheels 152A, 152B, 152C are identical to one another.

As illustrated in FIGS. 8C and 8D, thin-walled member 158 can be shaped with a folded, or S-shaped, configuration. Furthermore, the thin-walled member 158 can be constructed from a resilient material that can rebound from deformation. The combination of the folded configuration and the resilient material provides the booster wheel 152A with a pliancy well suited for engaging a variety of differently sized and shaped toy vehicles 900 with sufficient friction to accelerate a toy vehicle 900 along first or second tracks 120, 130 without lifting it off the tracks 120, 130.

As shown in FIG. 8C, the thin-walled member 158 includes an outer wall 160 at an outer diameter of the booster wheel 152A. Outer wall 160 is the portion of the booster wheel 152A that physically engages the toy vehicles 100. In the illustrated embodiment, the outer wall 160 is shaped like a cylinder. In other embodiments, the outer wall 160 can be shaped like a conical frustum or another suitable shape. In general, the outer wall 160 is shaped to provide sufficient friction against a toy vehicle 900 so that the outer wall 160 can grip the toy vehicle 900 and accelerate it forward as the booster wheel 152A rotates. The outer wall 160 is also shaped to avoid lifting toy vehicles 900 from the tracks 120, 130. As such, the outer wall 160 does not include any lips or protrusions that could cup the underside of a toy vehicle 900.

The outer wall 160 is at least partially defined by a terminal bottom edge 162 that is spaced away from an interior axle of the booster wheel 152A. In other words, the outer wall 160 is only supported from the top of the outer wall 160. The outer wall 160 has greater horizontal compliance because it is only supported from the top of the outer wall 160.

As further illustrated in FIG. 8C, the thin-walled member 158 includes an intermediate wall 164 concentrically interior the outer wall 160. The intermediate wall 164 can be shaped like a cylinder, a conical frustum, or another suitable shape. In the illustrated embodiment, the outer wall 160 and the intermediate wall 164 are substantially parallel, although this is not required in all embodiments. While the intermediate wall 164 is illustrated as being shorter than the outer wall 160, it can be the same height or even taller without departing from the scope of this disclosure. The relative heights of the outer wall 160 and the intermediate wall 164, and the spacing therebetween, can be selected to tune the relative horizontal compliance of the booster wheel 152A. The thickness of the thin-walled member 158 can also be selected to tune booster wheel 152A pliancy.

The thin-walled member 158 further includes an outer linkage 166 connecting the outer wall 160 to the intermediate wall 164. In the illustrated embodiment, the outer linkage 166 has a substantially U-shaped cross section, although this is not required in all embodiments. As shown in FIG. 8D, the outer linkage 166 can flex to allow a distance between the outer wall 160 and the intermediate wall 164 to decrease. In this manner, the outer wall 160 can give way to toy vehicles 900 having different widths and side profiles. The outer wall 160 can remain substantially vertical when the outer linkage 166 flexes, or the outer wall 160 can slant inward or outward. Such flexibility allows the booster wheel 152A to accommodate a variety of differently shaped toy vehicles 900.

The intermediate wall 164 includes an inner linkage 168 that connects the intermediate wall 164 to the interior of the booster wheel assembly. For example, the inner linkage 168 may be connected to central support 156, which is connected to wheel gear 154, which may be operatively connected to a rotation source, such as the electric motor 170 disposed within the platform 100. It should be understood that the illustrated arrangement is provided only as an example. The inner linkage 168 can be alternatively configured to accommodate different rotation sources and/or inner-wheel constructions.

In the illustrated embodiment, a portion of the inner linkage 168 has a substantially U-shaped cross section. The inner linkage 168 supports the intermediate wall 164 in a spaced-apart relationship relative the interior of the booster wheel 152A. As such, as shown in FIG. 8D, the inner linkage 168 can flex to allow a distance between the intermediate wall 164 and the interior of the booster wheel 152A to decrease. The inner linkage 168 cooperates with the intermediate wall 164 and the outer linkage 166 to support the outer wall 160 in a compliant manner, essentially serving as a tuned spring that allows the outer wall 160 to deform as necessary to accommodate variously shaped toy vehicles 900.

Returning to FIG. 8A, a rotation source in the form of the electric motor 170 disposed within the platform 100 is configured to impart rotation onto the wheel gear 154 of at least one of the booster wheels 152A, 152B, 152C. The electric motor 170 may be operatively coupled to the wheel gear 154 of at least one of the booster wheels 152A, 152B, 152C via a gear train. The electric motor 170 is configured to impart opposite rotations onto the booster wheels 152A and 152B, and opposite rotations onto the booster wheels 152B and 152C. More specifically, booster wheel 152A rotates in direction X, while booster wheel 152B rotates in direction Y, which is opposite of direction X. Furthermore, booster wheel 152C rotates in direction Z, which is the same as direction X, but the opposite of direction Y. The opposite directional rotations of booster wheels 152A and 152B provides the appropriate rotational direction for accelerating a toy vehicle 900 that enters the space therebetween, where that toy vehicle 900 is propelled by the rotating booster wheels 152A, 152B along the first track 120 of the platform 100. Furthermore, the opposite directional rotations of booster wheels 152B and 152C provides the appropriate rotational direction for acceleration a toy vehicle 900 that enters the space therebetween, where that toy vehicle 900 is propelled along the second track 130 of the platform 100. Furthermore, the gear ratios between the booster wheels 152A, 152B, 152C can be matched so that the booster wheels 152A, 152B, 152C all rotate at the same speed.

Figure 9A:
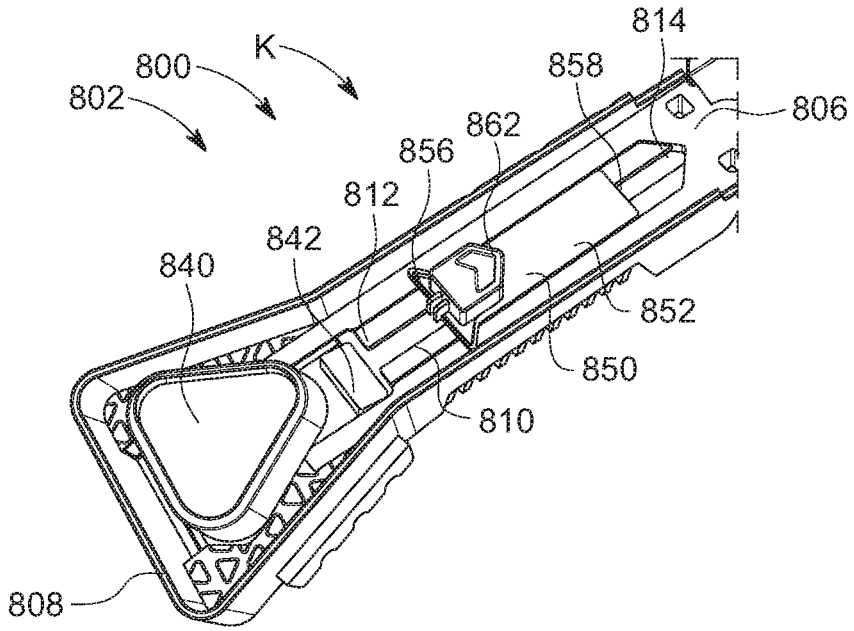
FIG. 9A illustrates a top view of the launcher of the embodiment of the toy vehicle playset illustrated in FIG. 1, the launcher being oriented in the launched configuration.
Figure 9B:
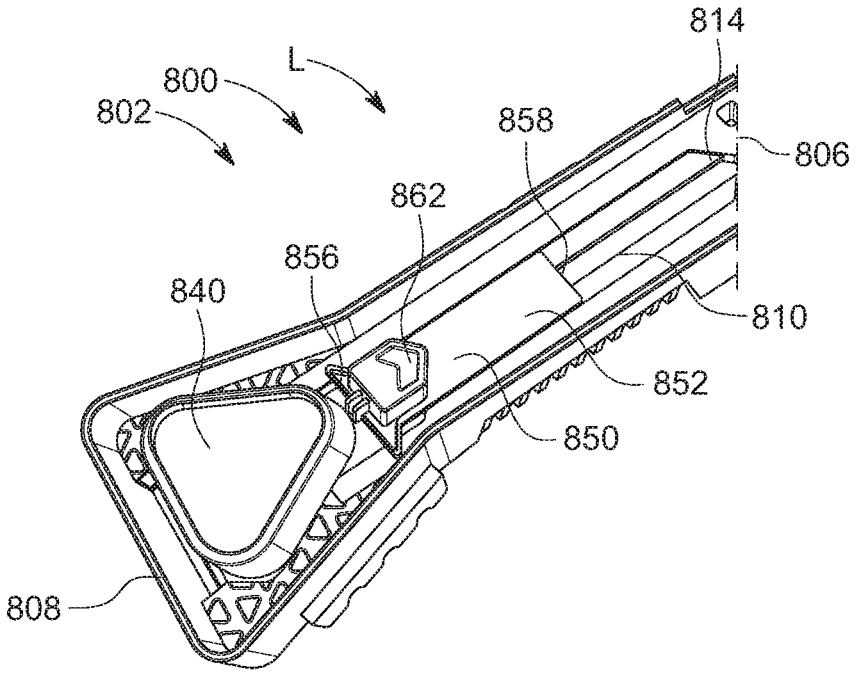
FIG. 9B illustrates a top view of the launcher illustrated in FIG. 9A of the embodiment of the toy vehicle playset illustrated in FIG. 1, the launcher being oriented in the loaded configuration.
Figure 9C:
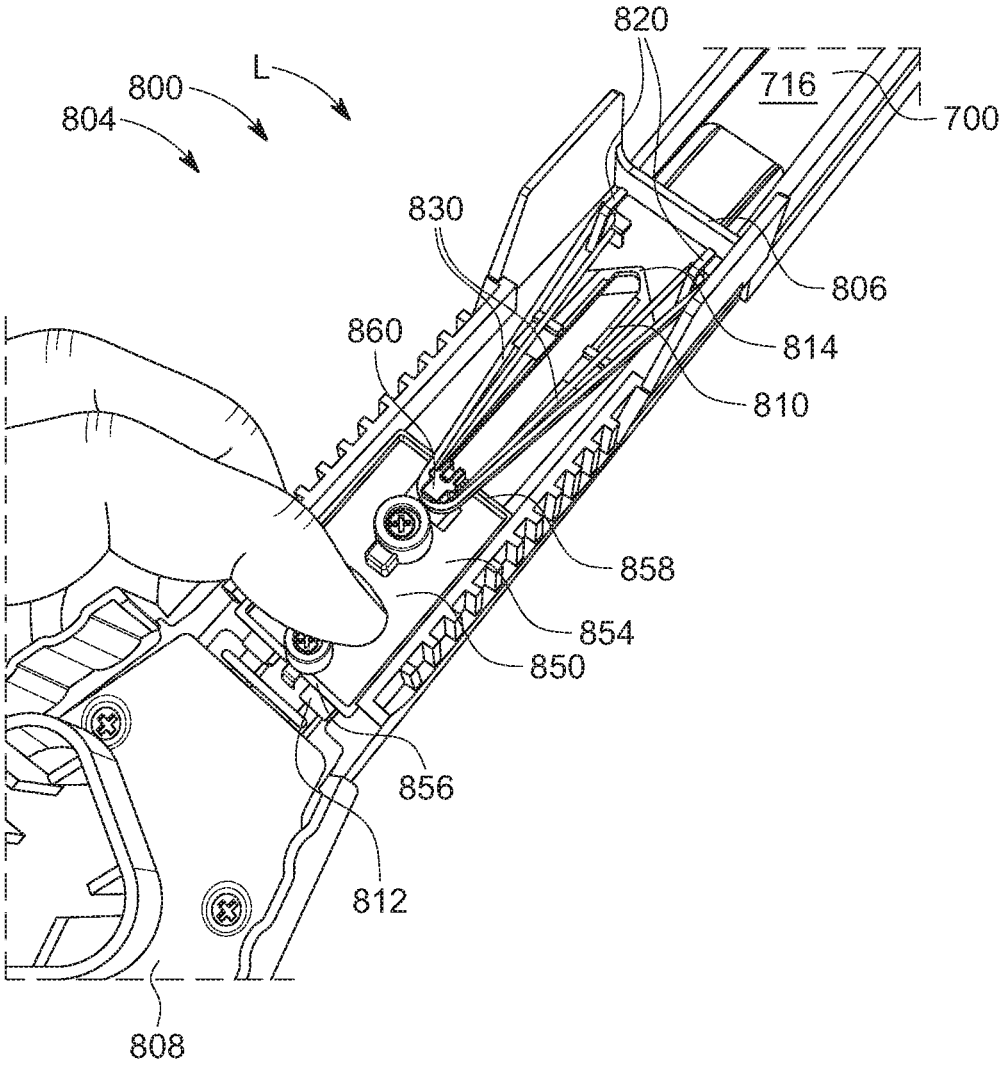
FIG. 9C illustrates a bottom view of the launcher illustrated in FIG. 9A of the embodiment of the toy vehicle playset illustrated in FIG. 1, the launcher being oriented in the loaded configuration.

Turning to FIGS. 9A, 9B, and 9C, illustrated is an embodiment of the toy vehicle launchers 800 of the toy vehicle playset 10. As previously explained and illustrated in FIG. 1, the toy vehicle launchers 800 are coupled to the platform 100 of the toy vehicle playset 10 via the launch tracks 700. More specifically, each of the launch tracks 700 includes a first end 710, which is coupled to a toy vehicle launcher 800, and a second end 712, which is coupled to the track connector arm 240 of the base 200, as previously explained with regard to FIGS. 4A, 4B, 4C, 4D, and 4E. Each of the toy vehicle launchers 800 is configured to launch a toy vehicle 900 from the launcher 800, across the launch track 700, and onto either the first or second track 120, 130 of the platform 100 via entry opening 310(1) of first ramp 300(1) or entry opening 460(1) of second ramp 400(1).

The launcher 800 includes a top surface 802, illustrated in FIGS. 9A and 9B, and an opposite bottom surface 804, illustrated in FIG. 9C. The launcher 800 may be elongated with a first end 806 and an opposite second end 808. The first end 806 of the launcher 800 may be coupled to the first end 710 of the launch track 700. Furthermore, the launch track 800 may contain a slot 810 that is disposed through the top and bottom surfaces 802, 804 and between the first and second ends 806, 808. The slot 810 includes a proximal end 812, which is disposed proximate to the second end 808 of the launcher 800, and an opposite distal end 814, which is disposed proximate to the first end 806 of the launcher 800. Disposed on the top surface 802 of the launcher between the second end 808 of the launcher 800 and the proximal end 812 of the slot 810 is an actuator 840. The actuator 840 includes a catch 842 that extends into the proximal end 812 of the slot 810. The actuator 840 may be depressible, such that, when the actuator 840 is depressed, the catch 842 slides downwardly from and out of the proximal end 812 of the slot 810. As further illustrated in FIG. 9C, extending downwardly from the bottom surface 804 of the launcher 800 proximate to the first end 806 is a pair of hooks 820. The pair of hooks 820 are disposed on opposite sides of the distal end 814 of the slot 810.

FIGS. 9A, 9B, and 9C further illustrate an impactor 850 that is slidably disposed within the slot 810. The impactor 850 includes a top side 852, an opposite bottom side 854, a proximal end 856, and a distal end 858. The impactor 850 is disposed within the slot 810 such that the top side 852 of the impactor 850 is disposed on the top surface 802 of the launcher 800, and the bottom side 854 of the impactor 850 is disposed on the bottom surface 804 of the launcher 800. As illustrated in FIG. 9C, extending from the bottom side 854 proximate to the distal end 858 of the impactor 850 is a projection 864. FIG. 9C further illustrates a resilient member 830 extending between the pair of hooks 820 of the launcher 800 and the projection 864 of the impactor 850. As illustrated in FIGS. 9A and 9B, extending upwardly from the top side 852 of the impactor 854, proximate to the proximal end 856 is a protrusion 862.

FIGS. 9A, 9B, and 9C illustrate that the impactor 950 is repositionable between a launched position K and a loaded position L. When in the loaded position L, the proximal end 856 of the impactor 850 is disposed proximate to the proximal end 812 of the slot 810 such that the proximal end 856 of the impactor 850 is in engagement with the catch 842 of the actuator 840. Furthermore, in the loaded position L, the distal end 858 of the impactor 850 is spaced farthest from the distal end 814 of the slot 810 and the first end 806 of the launcher. As illustrated in FIG. 9C, when the impactor 850 is in the loaded position L, the resilient member 830 is stretched or elongated by the projection 864 of the impactor 800 being spaced farthest from the pair of hooks 820 of the launcher 800.

To reposition the impactor 850 from the loaded position L to the launched position K, a user may depress the actuator 840, which moves the catch 842 out of engagement with the proximal end 856 of the impactor 850. The resiliency of the stretched and elongated resilient member 830 propels the impactor 850 along the slot 810 such that the distal end 858 of the impactor 850 is rapidly moved toward the distal end 814 of the slot 810 and the first end 806 of the launcher 800. When a toy vehicle 900 is disposed on the to surface 802 of the launcher 800 and the impactor 850 is repositioned from the loaded position L to the launched position K, the protrusion 862 on the top side 852 of the impactor 850 strikes or impacts the toy vehicle 900 to propel the toy vehicle 900 down the launch track 700 toward the platform 100. Once the impactor 850 is in the launched position K, to return the impactor 850 to the loaded position L, a user must pull or push the impactor 850 along the slot 810 until the proximal end 856 of the impactor 850 engages with the catch 842 of the actuator 840 of the launcher 800.

During operation of the toy vehicle playset 10, a user may attempt to launch a toy vehicle 900 from a launcher 800, across the launch track 700, and into either the entry opening 310(1) of the first ramp 300(1) or the entry opening 460(1) of the second ramp 400(1). As previously described, the motor 170 disposed within the platform 100 is configured to rotate the platform 100 about axis A with respect to the base 200. Because the launchers 800 are coupled to the launch tracks 700, which are coupled to the track connector arms 240 of the base 200, the platform 100 also rotates with respect to the launchers 800 and the launch tracks 700. Thus, the base 200, the launchers 800, and the launch tracks 700 remain stationary as the platform 100 rotates about axis A. A user must time the launch of the toy vehicle 900 from the launcher 800 in order to launch the toy vehicle 900 into the entry opening 310(1) of the first ramp 300(1) or the entry opening 460(1) of the second ramp 400(1) (i.e., the entry opening 310(1) of the first ramp 300(1) or the entry opening 460(1) of the second ramp 400(1) must be located proximate to or aligned with the second end 712 of the launch track 700 when the toy vehicle 900 travels off of the second end 712 of the launch track 700).

If the launch of the toy vehicle 900 is timed correctly, the toy vehicle 900 travels off from the second end 712 of the launch track 700 when the entry opening 310(1) of the first ramp 300(1) or the entry opening 460(1) of the second ramp 400(1) is aligned with the second end 712 of the launch track 700, and enters one of the entry openings 310(1), 460(1). As previously explained, if the toy vehicle 900 is launched into the entry opening 310(1) of the first ramp 300(1), the toy vehicle 900 would push or reposition the door 330(1) of the first ramp 300(1) from the closed position B to the open position C, and enter onto the first track 120 of the platform 100. Conversely, if the toy vehicle 900 is launched into the entry opening 460(1) of the second ramp 400(1), the toy vehicle 900 would push or reposition the door 440(1) of the second ramp 400(1) from the closed position E to the open position F, and enter onto the second track 130 of the platform 100.

The first and second tracks 120, 130 of the platform 100, the first ramps 300(1), 300(2), the second ramps 400(1), 400(2), and the overhead tracks 500(1), 500(2), 500(3) collectively form a continuous closed loop track over which a toy vehicle 900 may continuously travel until impeded by another toy vehicle 900 or stopped by the user of the toy vehicle playset 100. The booster mechanism 150 is configured to repeatedly propel and accelerate the toy vehicles 900 along the continuous closed loop track each time a toy vehicle 900 passes between the first and second booster wheels 152A, 152B when traveling along the first track 120 of the platform 100, and each time a toy vehicle 900 passes between the second and third booster wheels 152B, 152C when traveling along the second track 130 of the platform 100. Moreover, the diverter mechanism 600 may dictate which overhead track 500(1), 500(2), 500(3) the toy vehicles 900 travel onto when traveling up the second ramps 400(1), 400(2), while toy vehicles 900 traveling down the second ramps 400(1), 400(2) may cause the diverter mechanism 600 to be repositioned.

For the embodiment of the toy vehicle playset 10 illustrated, when a toy vehicle 900 is launched through the entry opening 310(1) of the first ramp 300(1), the toy vehicle travels along the first track 120 from first ramp 300(1) toward first ramp 300(2). Between the first ramps 300(1), 300(2), the booster mechanism 150 (i.e., first and second booster wheels 152A, 152B) accelerate the toy vehicle 900 up first ramp 300(2), along overhead track 500(3), and down second ramp 400(1). As the toy vehicle 900 travels down second ramp 400(1), the toy vehicle 900 would reposition the diverter mechanism 600 such that the distal end 644 of the first diverter paddle 640 is disposed adjacent to the first sidewall 410(1) of the second ramp 400(1) and the distal end 654 of the second diverter paddle 650 is disposed adjacent to the second sidewall 420(2) of the second ramp 400(2). The toy vehicle 900 would continue to travel down second ramp 400(1) along pathway I and along the second track 130 of the platform 100 toward second ramp 400(2). Between the second ramps 400(1), 400(2), the booster mechanism 150 (i.e., second and third booster wheels 152B, 152C) accelerates the toy vehicle 900 a second time, where the toy vehicle 900 is propelled up second ramp 400(2) along pathway H, along overhead track 500(2), and down second ramp 400(1) a second time.

As the toy vehicle 900 travels down second ramp 400(1) for the second time, the toy vehicle 900 would again reposition the diverter mechanism 600 such that the distal end 644 of the first diverter paddle 640 is disposed adjacent to the second sidewall 420(1) of the second ramp 400(1), and the distal end 654 of the second diverter paddle 650 is disposed adjacent to the first sidewall 410(2) of the second ramp 400(2). The toy vehicle 900 would continue to travel down second ramp 400(1) along pathway H and along the second track 130 of the platform 100 toward second ramp 400(2). The toy vehicle 900 would receive another acceleration (i.e., the third acceleration) by the booster mechanism 150 (i.e., second and third booster wheels 152B, 152C) as the toy vehicle travels along the second track 130 between the second ramps 400(1), 400(2) for the second time. This third acceleration by the booster mechanism 150 accelerates the toy vehicle 900 up second ramp 400(2) along pathway I, along overhead track 500(1), and down first ramp 300(1), thus completing one pass by the toy vehicle 900 through the continuous closed loop track. Moreover, the toy vehicle 900 may continue to travel along the continuous closed loop track until another toy vehicle 900 launched onto the platform 100 impedes the first toy vehicle 900, the user stops the toy vehicle 900, or the user turns off power to the booster mechanism 150 of the platform 100.

With opposing launchers 800, as illustrated in FIG. 1, multiple users may attempt to launch a plurality of toy vehicles 900 into the continuous closed loop track to compete and determine which user is able to position the most toy vehicles along the continuous closed loop track prior to the toy vehicles 900 colliding with one another.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle playset, comprising:

a base;

a platform rotatably coupled to the base, the platform comprising:

at least one track disposed within a top surface of the platform, at least one ramp extending upwardly from the top surface of the platform and coupled to the at least one track, and at least one overhead track coupled to the at least one ramp, where the at least one track, the at least one ramp, and the at least one overhead track form a continuous track; and a launcher coupled to the base and spaced from the platform, the launcher configured to launch a toy vehicle onto the continuous track of the platform as the platform rotates about a vertical axis with respect to the base and the launcher.

2. The toy vehicle playset of claim 1, further comprising:

a motor disposed within the platform, the motor being configured to drive the rotation of the platform about the vertical axis.

3. The toy vehicle playset of claim 2, wherein the platform further comprises a booster mechanism driven by the motor and configured to accelerate a toy vehicle along the continuous track.

4. The toy vehicle playset of claim 1, wherein the vertical axis extends coaxially though the base and the platform.

5. The toy vehicle playset of claim 1, wherein the at least one track is a first track, and the platform further comprising a second track disposed in the top surface of the platform such that the first and second tracks intersect each other.

6. The toy vehicle playset of claim 5, wherein the at least one ramp is a first ramp, and the platform further comprising a second ramp, a third ramp, and a fourth ramp, and wherein the first track extends across the top surface of the platform between the first ramp and the second ramp, and the second track extends across the top surface of the platform between the third ramp and the fourth ramp.

7. The toy vehicle playset of claim 6, wherein the at least one overhead track is a first overhead track, and the platform further comprising a second overhead track and a third overhead track, where the first overhead track is coupled to the first ramp and the third ramp over the top surface of the platform, the second overhead track is coupled to the third ramp and the fourth ramp over the top surface of the platform, and the third overhead track is coupled to the fourth ramp and the second ramp over the top surface of the platform.

8. The toy vehicle playset of claim 7, wherein the platform further comprises a diverter mechanism rotatably coupled between the third ramp and the fourth ramp.

9. A toy vehicle playset, comprising:

a base;

a platform coupled to the base, the platform being rotatable about a vertical axis, the platform comprising:

a first track section disposed on the platform, a ramp extending upwardly from the platform and coupled to the first track section, and an overhead track coupled to the ramp, wherein the first track section, the ramp, and the overhead track collectively forming a continuous track;

a second track section; and a launcher coupled to the second track section, the launcher configured to launch a toy vehicle along the second track section and onto the continuous track as the platform rotates relative to the base and the launcher.

10. The toy vehicle playset of claim 9, further comprising:

a motor disposed within the platform, the motor rotating the platform relative to the base.

11. The toy vehicle playset of claim 10, wherein the platform further comprises a booster mechanism driven by the motor and configured to accelerate a toy vehicle along the continuous track.

12. The toy vehicle playset of claim 9, wherein the vertical axis extends coaxially though the base and the platform.

13. The toy vehicle playset of claim 9, wherein the platform further comprises a third track section that is located on the top surface of the platform, the first track section and the second track section intersecting each other.

14. The toy vehicle playset of claim 13, wherein the ramp is a first ramp, and the platform further comprising a second ramp, a third ramp, and a fourth ramp, the first track section extends across the top surface of the platform between the first ramp and the second ramp, and the second track section extends across the top surface of the platform between the third ramp and the fourth ramp.

15. The toy vehicle playset of claim 14, wherein the overhead track is a first overhead track, and the platform further comprises a second overhead track and a third overhead track, where the first overhead track is coupled to the first ramp and the third ramp over the top surface of the platform, the second overhead track is coupled to the third ramp and the fourth ramp over the top surface of the platform, and the third overhead track is coupled to the fourth ramp and the second ramp over the top surface of the platform.

16. The toy vehicle playset of claim 15, wherein the platform further comprises a diverter mechanism rotatably coupled between the third ramp and the fourth ramp.

17. A toy vehicle playset, comprising:

a base;

a platform rotatably coupled to the base, the platform having a top surface and comprising:

a first track, a first ramp extending upwardly from the top surface, the first ramp being coupled to the first track, and a first overhead track coupled to the first ramp, the first track, the first ramp, and the first overhead track forming a continuous track; and a launcher configured to launch a toy vehicle onto the continuous track of the platform as the platform rotates about a vertical axis.

18. The toy vehicle playset of claim 17, further comprising:

a motor disposed within the platform, the motor being configured to rotate the platform.

19. The toy vehicle playset of claim 18, wherein the platform includes a booster mechanism driven by the motor and configured to accelerate a toy vehicle along the continuous track.

20. The toy vehicle playset of claim 17, wherein the platform rotates about a vertical axis.

* * * * *